US008257022B2

(12) United States Patent
Guemmer

(10) Patent No.: US 8,257,022 B2
(45) Date of Patent: Sep. 4, 2012

(54) FLUID FLOW MACHINE FEATURING A GROOVE ON A RUNNING GAP OF A BLADE END

(75) Inventor: Volker Guemmer, Mahlow (DE)

(73) Assignee: Rolls-Royce Deutschland Ltd Co KG (DE)

( * ) Notice: Subject to any disclaimer, the term of this patent is extended or adjusted under 35 U.S.C. 154(b) by 488 days.

(21) Appl. No.: 12/498,050

(22) Filed: Jul. 6, 2009

(65) Prior Publication Data

US 2010/0014956 A1 Jan. 21, 2010

(30) Foreign Application Priority Data

Jul. 7, 2008 (DE) ..... 10 2008 031 982

(51) Int. Cl.
*F04D 29/52* (2006.01)

(52) U.S. Cl. ..... 415/58.6; 415/144

(58) Field of Classification Search ..... 415/58.6, 415/58.7, 170.1, 173.1, 144
See application file for complete search history.

(56) References Cited

U.S. PATENT DOCUMENTS

| | | | | |
|---|---|---|---|---|
| 2,933,238 | A | | 4/1960 | Stalker |
| 3,066,912 | A | | 12/1962 | Scheper |
| 3,572,960 | A | | 3/1971 | McBride |
| 3,694,102 | A | | 9/1972 | Conrad |
| 3,846,038 | A | | 11/1974 | Carriere et al. |
| 3,849,023 | A | | 11/1974 | Klompas |
| 3,993,414 | A | | 11/1976 | Meauze et al. |
| 4,155,680 | A | | 5/1979 | Linko et al. |
| 4,415,310 | A | | 11/1983 | Bouiller et al. |
| 4,466,772 | A | | 8/1984 | Okapuu et al. |
| 4,479,755 | A | | 10/1984 | Skoe |
| 4,642,027 | A | | 2/1987 | Popp |
| 4,659,282 | A | * | 4/1987 | Popp ..... 415/177 |
| 5,059,093 | A | | 10/1991 | Khalid et al. |

(Continued)

FOREIGN PATENT DOCUMENTS

DE 889506 9/1953

(Continued)

OTHER PUBLICATIONS

German Search Report dated Jul. 1, 2011 from the counterpart German patent application.

(Continued)

*Primary Examiner* — Edward Look
*Assistant Examiner* — Liam McDowell
(74) *Attorney, Agent, or Firm* — Timothy J. Klima; Shuttleworth & Ingersoll, PLC

(57) ABSTRACT

A fluid-flow machine has at least one row of blades 5 having blade ends moving relative to one of a hub 3 and a casing 1, with a gap 11 positioned therebetween. At least one groove 7 extends essentially in a circumferential direction of the machine is in an area of the gap 11 along at least part of the circumference, with the extension of the groove 7 in the circumferential direction being large as compared to the extension of the groove 7 in the meridional flow direction. A cross-sectional area of the groove 7, in meridional view of the fluid-flow machine, essentially departs from a parallelogrammic shape and, due to its contour, is inclined in an upstream direction. A centroid of the groove cross-sectional area is provided upstream of the center of the groove aperture 12 on the main flow path.

21 Claims, 27 Drawing Sheets

Figure 1A:
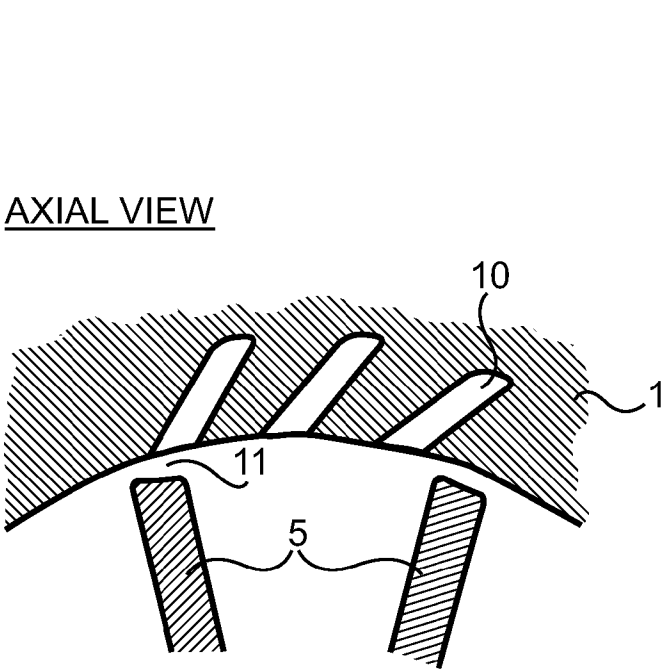
Figure 1A:
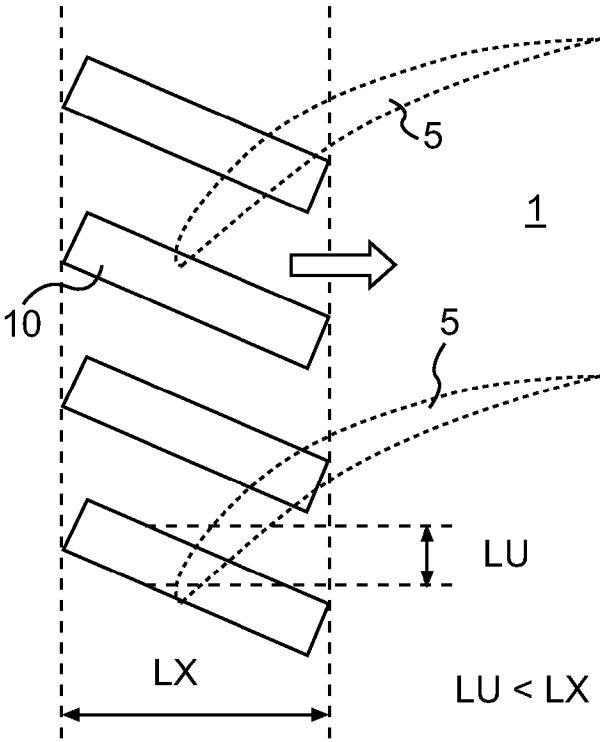

| | | | |
|---|---|---|---|
| | | | $w / L_m < 0,2$ |
| $h / w < 10$ | $A_F / A_R > 0,1$ | $m / w > 0,1$ | $d / w > 0,05$ |

U.S. PATENT DOCUMENTS

| | | | | |
|---|---|---|---|---|
| 5,203,162 | A | 4/1993 | Burge | |
| 5,230,605 | A | 7/1993 | Yamaguchi | |
| 5,308,225 | A | 5/1994 | Koff et al. | |
| 5,327,716 | A | 7/1994 | Giffin et al. | |
| 5,431,533 | A | 7/1995 | Hobbs | |
| 5,474,417 | A | 12/1995 | Privett et al. | |
| 5,480,284 | A | 1/1996 | Wadia et al. | |
| 5,707,206 | A | 1/1998 | Goto et al. | |
| 5,762,034 | A | 6/1998 | Foss | |
| 5,762,470 | A | 6/1998 | Gelmedov et al. | |
| 5,876,182 | A | 3/1999 | Schulte | |
| 5,950,308 | A | 9/1999 | Koff et al. | |
| 6,109,868 | A | 8/2000 | Bulman et al. | |
| 6,234,747 | B1 * | 5/2001 | Mielke et al. | 415/119 |
| 6,290,458 | B1 | 9/2001 | Irie et al. | |
| 6,574,965 | B1 * | 6/2003 | Feulner | 60/785 |
| 6,585,479 | B2 | 7/2003 | Torrance | |
| 6,619,909 | B2 * | 9/2003 | Barnett et al. | 415/57.4 |
| 6,663,346 | B2 | 12/2003 | Munsell et al. | |
| 6,742,983 | B2 | 6/2004 | Schmuecker | |
| 6,832,890 | B2 * | 12/2004 | Booth | 415/173.1 |
| 7,077,623 | B2 | 7/2006 | Guemmer | |
| 7,097,414 | B2 | 8/2006 | Stangeland | |
| 7,186,072 | B2 * | 3/2007 | Seitz | 415/57.1 |
| 7,387,487 | B2 | 6/2008 | Guemmer | |
| 7,575,412 | B2 * | 8/2009 | Seitz | 415/58.5 |
| 7,594,793 | B2 | 9/2009 | Guemmer | |
| 7,645,121 | B2 * | 1/2010 | Tudor | 415/220 |
| 7,811,049 | B2 | 10/2010 | Xu | |
| 7,861,823 | B2 * | 1/2011 | Prasad et al. | 181/214 |
| 2003/0026695 | A1 | 2/2003 | Schmuecker | |
| 2004/0081552 | A1 | 4/2004 | Guemmer | |
| 2005/0019152 | A1 | 1/2005 | Seitz | |
| 2005/0058541 | A1 | 3/2005 | LeBiez et al. | |
| 2005/0226717 | A1 | 10/2005 | Xu | |
| 2005/0238483 | A1 | 10/2005 | Guemmer | |
| 2006/0051199 | A1 | 3/2006 | Guemmer | |
| 2006/0104805 | A1 | 5/2006 | Guemmer | |
| 2006/0153673 | A1 * | 7/2006 | Guemmer | 415/115 |
| 2008/0044273 | A1 | 2/2008 | Khalid | |
| 2008/0199306 | A1 | 8/2008 | Lebret | |
| 2009/0160135 | A1 | 6/2009 | Turini et al. | |
| 2009/0290974 | A1 | 11/2009 | Bayere et al. | |

FOREIGN PATENT DOCUMENTS

| | | |
|---|---|---|
| DE | 1042828 | 11/1958 |
| DE | 1428188 | 11/1968 |
| DE | 3407945 | 9/1985 |
| DE | 19632207 | 2/1998 |
| DE | 10135003 | 10/2002 |
| DE | 10233032 | 1/2004 |
| DE | 10330084 | 3/2004 |
| DE | 102004043036 | 3/2006 |
| EP | 0497574 | 9/1995 |
| EP | 0718469 | 6/1996 |
| EP | 0754864 | 1/1997 |
| EP | 0719908 | 3/2000 |
| EP | 1013937 | 6/2000 |
| EP | 1286022 | 2/2003 |
| EP | 1382855 | 1/2004 |
| GB | 619722 | 3/1949 |
| GB | 987625 | 3/1965 |
| GB | 2408546 | 6/2005 |
| WO | 9510692 | 4/1995 |

OTHER PUBLICATIONS

European Search Report dated Nov. 22, 2006 from related patent application [472].

German Search Report dated Oct. 14, 2011 from related application [542].

Yang, Zhou. "Boundary Layer Separation Control on a Highly-Loaded, Low-Solidity Compressor Cascade." Journal of Thermal Science 19.2 (2010): 97-104.

Strazisar, A.J., Bright, M.B., Thorp, S., Culley, D.E., Suder, K.L., "Compressor Stall Control Through Endwall Recirculation", ASME GT2004-54295, proceedings of the ASME Turbo Expo 2004, Jun. 14-17, 2005, Vienna, Austria.

Gao, P., Zhang, Y., Zhang, S., "Numerical Investigation of the Different Casing Treatment in a Centrifugal Compressor", Proceeding APWCS '10 Proceeings of the 2010 Asia-Pacific Conference on Wearable Computing Systems.

Moore, R., Effect of Casing Treatment on Overall and Blade-Element Performance of a Compressor Rotor. NASA TN D-6538. Nov. 1971.

Jian H., Hu, W., "Numerical Investigation of Inlet Distortion on an Axial Flow Compressor Rotor with Circumferential Groove Casing Treatment", Chinese Journal of Aeronautics, 21 (2008) 496-505.

Friedrichs, Jens, Sven Baumgarten, Gunter Kosyna, and Udo Stark, "Effect of Stator Design on Stator Boundary Layer Flow in a Highly Loaded Single-Stage Axial Flow Low-Speed Compressor." Journal of Turbomachinery 123.3 (2001): 483.

German Search Report dated Jun. 8, 2011 from a related application [568].

* cited by examiner

| | | | |
|---|---|---|---|
| h / w < 10 | $A_F / A_R > 0,1$ | m / w > 0,1 | w / $L_m$ < 0,2 |
| | | | d / w > 0,05 |

FLUID FLOW MACHINE FEATURING A GROOVE ON A RUNNING GAP OF A BLADE END

This application claims priority to German Patent Application DE102008031982.1 filed Jul. 7, 2008, the entirety of which is incorporated by reference herein.

This invention relates to a fluid flow machine.

More particularly, the invention relates to a fluid flow machine with a main flow path confined by a hub and a casing, in which at least one row of blades is arranged which forms a running gap to the hub or the casing.

The aerodynamic loadability and the efficiency of fluid flow machines such as blowers, compressors, pumps and fans, is limited in particular by the growth and the separation of boundary layers in the rotor and stator blade tip area near the casing or the hub wall, respectively. On blade rows with running gaps, this leads to re-flow phenomena and the occurrence of instability of the machine at higher loads.

Fluid flow machines according to the state of the art either have no particular features to provide remedy in this area, or so-called casing treatments are used as counter-measure which include a) slots/apertures and chambers in the casing above the rotor. The apertures here are always rectangular or parallelogrammic, b) slots in the casing, which are essentially oriented in a flow direction, are of a slender form and feature a small extension as viewed in a circumferential direction of the machine, c) circumferential grooves with rectangular or parallelogrammic cross-section.

Known solutions are revealed for example in the following documents: US2005/0226717A1, EP0754864A1, DE10135003C1 and DE10330084A1. A sketch of usual slots and grooves 10 is provided in FIGS. 1*a* and 1*b*.

Simple existing concepts of casing treatments in the form of slots and/or chambers in the annulus duct wall, as known from the state of the art, provide for an increase in the stability of the fluid flow machine. However, due to unfavorably selected arrangement and shaping, this increase in stability is unavoidably accompanied by a loss in efficiency. The known solutions partly consume much space at the periphery of the annulus duct of the fluid flow machine or, due their shape (e.g. simple, parallelogrammic circumferential casing grooves), have only limited efficiency and are restricted to the arrangement of a rotor blade row enclosed by a casing.

A broad aspect of the present invention is to provide a fluid flow machine of the type specified above which, while avoiding the disadvantages of the state of the art, is characterized by exerting a highly effective influence on the boundary layer in the blade tip area.

According to the present invention, an optimized configuration of the groove is therefore described which enables the flow conditions in the area of the blade rim and the running gap to be optimized.

More particularly, the present invention relates to a section of the annulus duct of a fluid flow machine in the area of a blade row with free end and running gap, in which a groove having an aerodynamically favorable cross-section and extending essentially in the circumferential direction of the machine is provided, with the groove cross-section being non-parallelogrammic and, due to its contour, being oriented in the upstream direction. The concept pertains to arrangements with running gap and relative movement between blade end and main flow path confinement, both on the casing and on the hub.

The present invention therefore relates to fluid flow machines, such as blowers, compressors, pumps and fans of the axial, semi-axial and radial type. The working medium or fluid may be gaseous or liquid.

The fluid flow machine may include one or several stages, each having a rotor and a stator, in individual cases, the stage is formed by a rotor only.

The rotor includes a number of blades, which are connected to the rotating shaft of the machine and impart energy to the working medium. The rotor may be designed with or without a shroud at the outward blade ends.

The stator includes a number of stationary vanes, which may either feature a fixed or a free blade end on the hub and on the casing side.

Rotor drum and blading are usually enclosed by a casing 1, in other cases (e.g. aircraft or ship propellers) no such casing exists. See FIGS. 2A-2D.

The machine may also feature a stator, a so-called inlet guide vane assembly, upstream of the first rotor. Departing from the stationary fixation, at least one stator or inlet guide vane assembly may be rotatably borne, to change the angle of attack. Variation is accomplished for example via a spindle accessible from the outside of the annulus duct 2.

In a special configuration, the fluid flow machine may have at least one row of variable rotors.

Figure 2A:
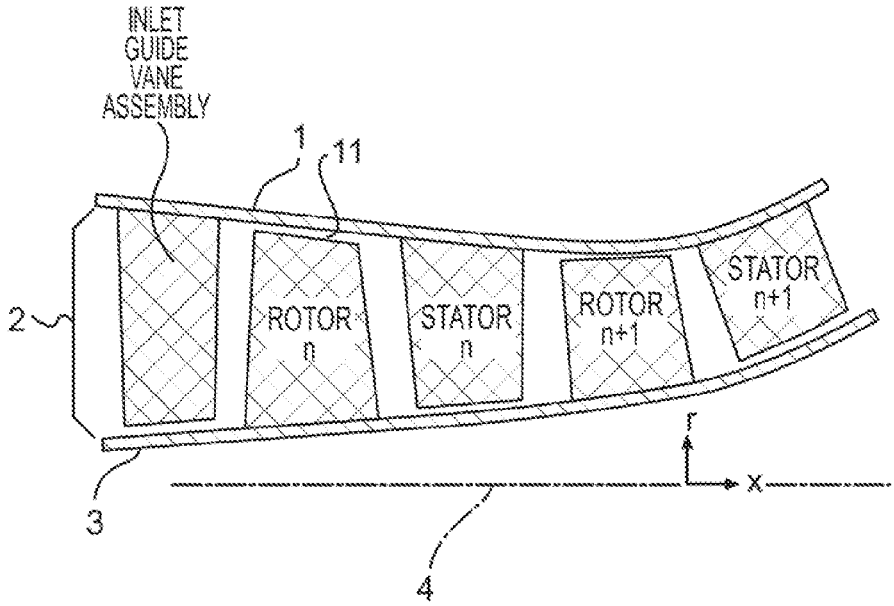
FIG. 2A (Prior Art)
Figure 2B:
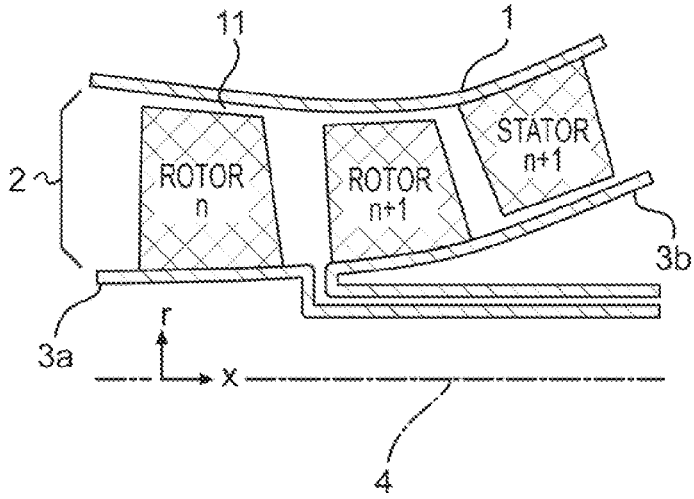
FIG. 2B (Prior Art)
Figure 2C:
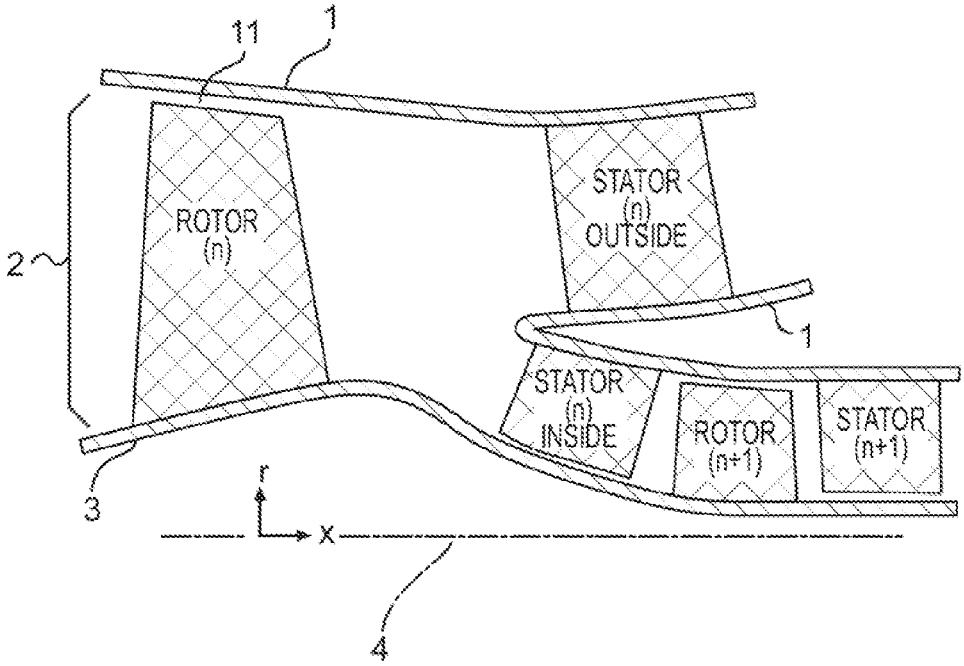
FIG. 2C (Prior Art)
Figure 2D:
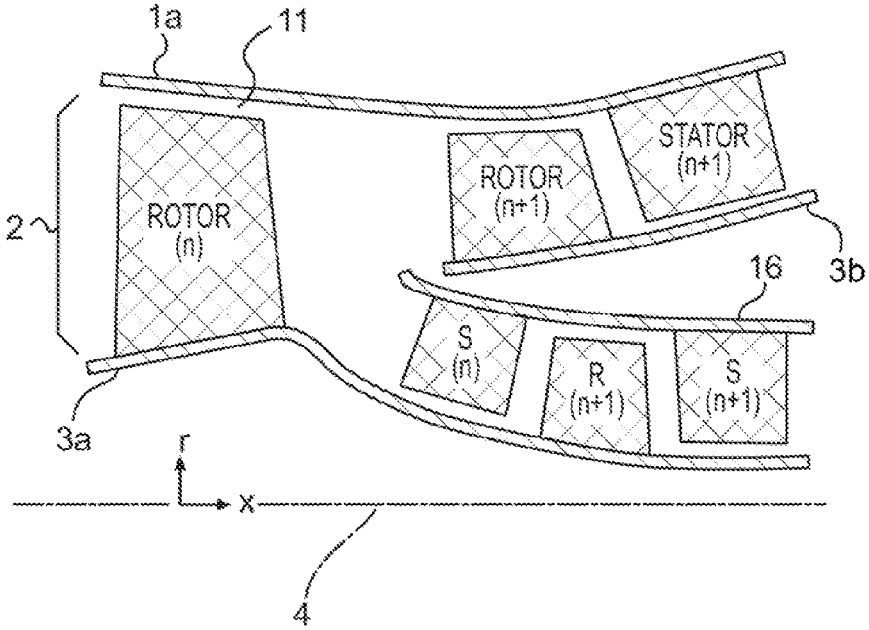
FIG. 2D (Prior Art)

In an alternative configuration as can be seen in FIGS. 2B and 2D, multi-stage types of fluid flow machines according to the present invention may have two counter-rotating shafts, with the direction of rotation of the rotor blade rows alternating between stages. Here, no stators exist between subsequent rotors n and n+1, mounted respectively on rotor drums 3*a* and 3*b*.

Finally, the fluid flow machine may—alternatively—feature a bypass configuration such that the single-flow annulus duct divides into two concentric annuli behind a certain blade row, with each of these annuli housing at least one further blade row.

FIGS. 2A-2D (Prior Art) show examples of fluid flow machines relevant to the present invention.

Figure 1B:
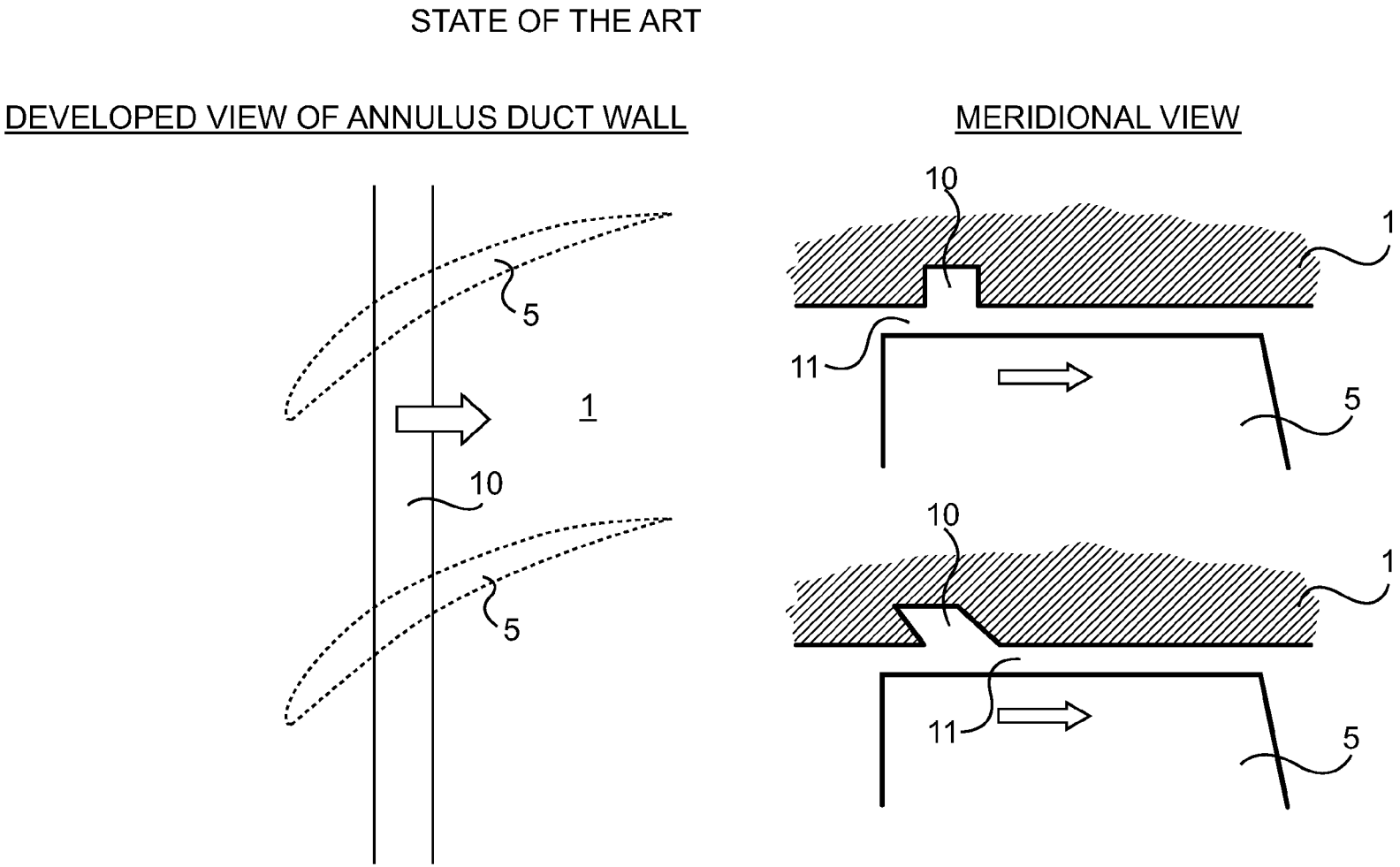
Figure 3:
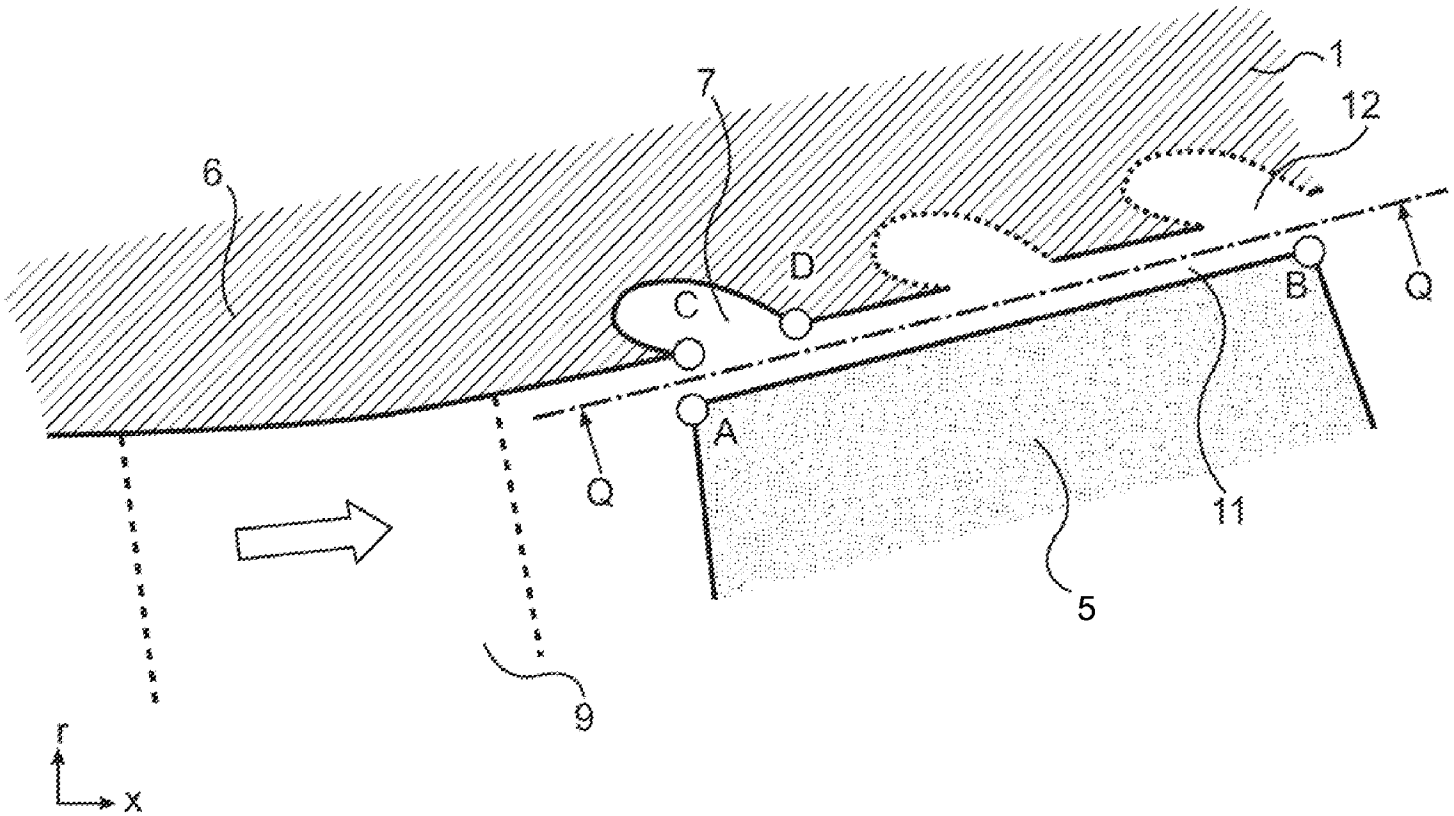
Figure 4A:
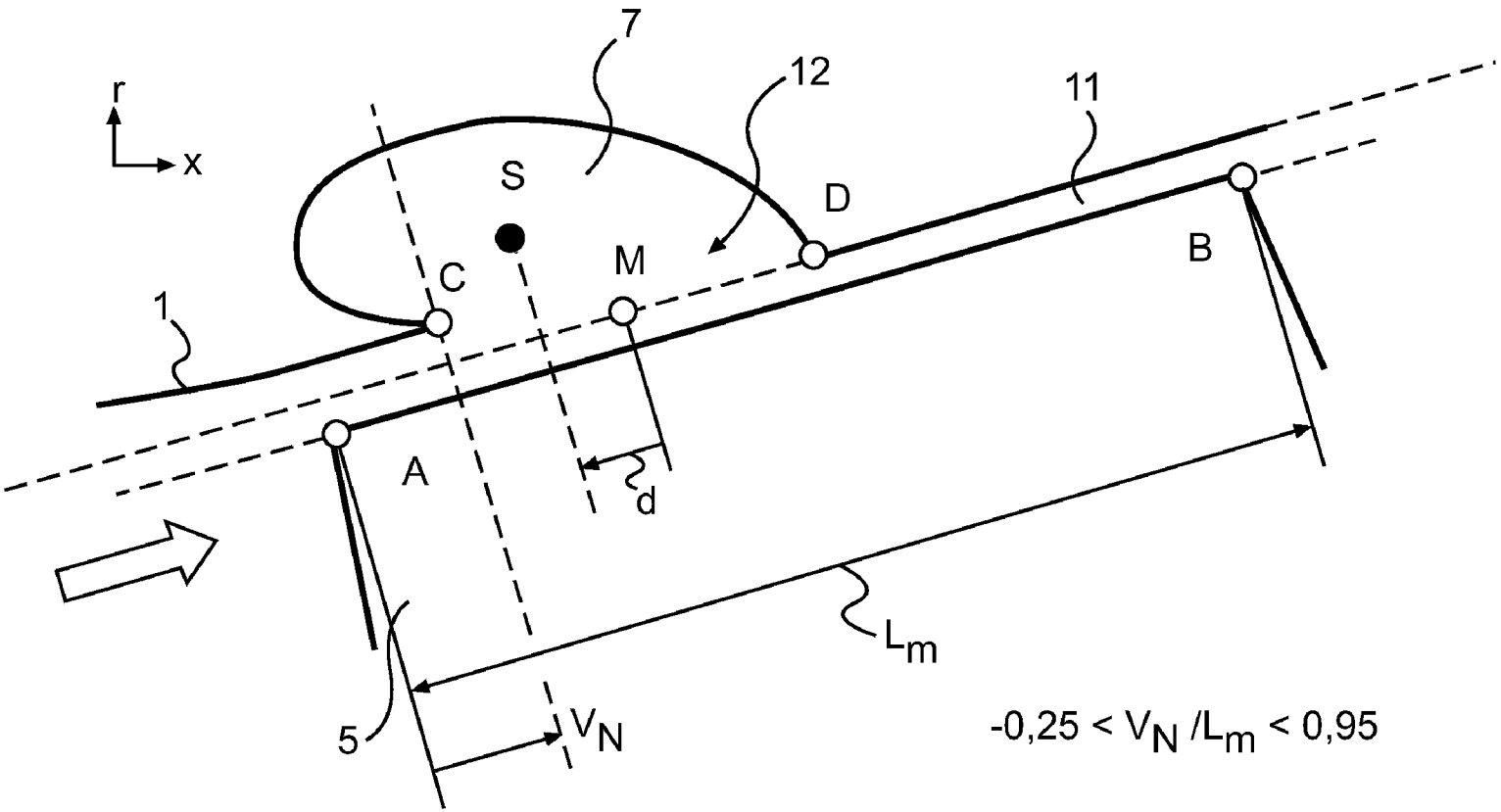
Figure 4B:
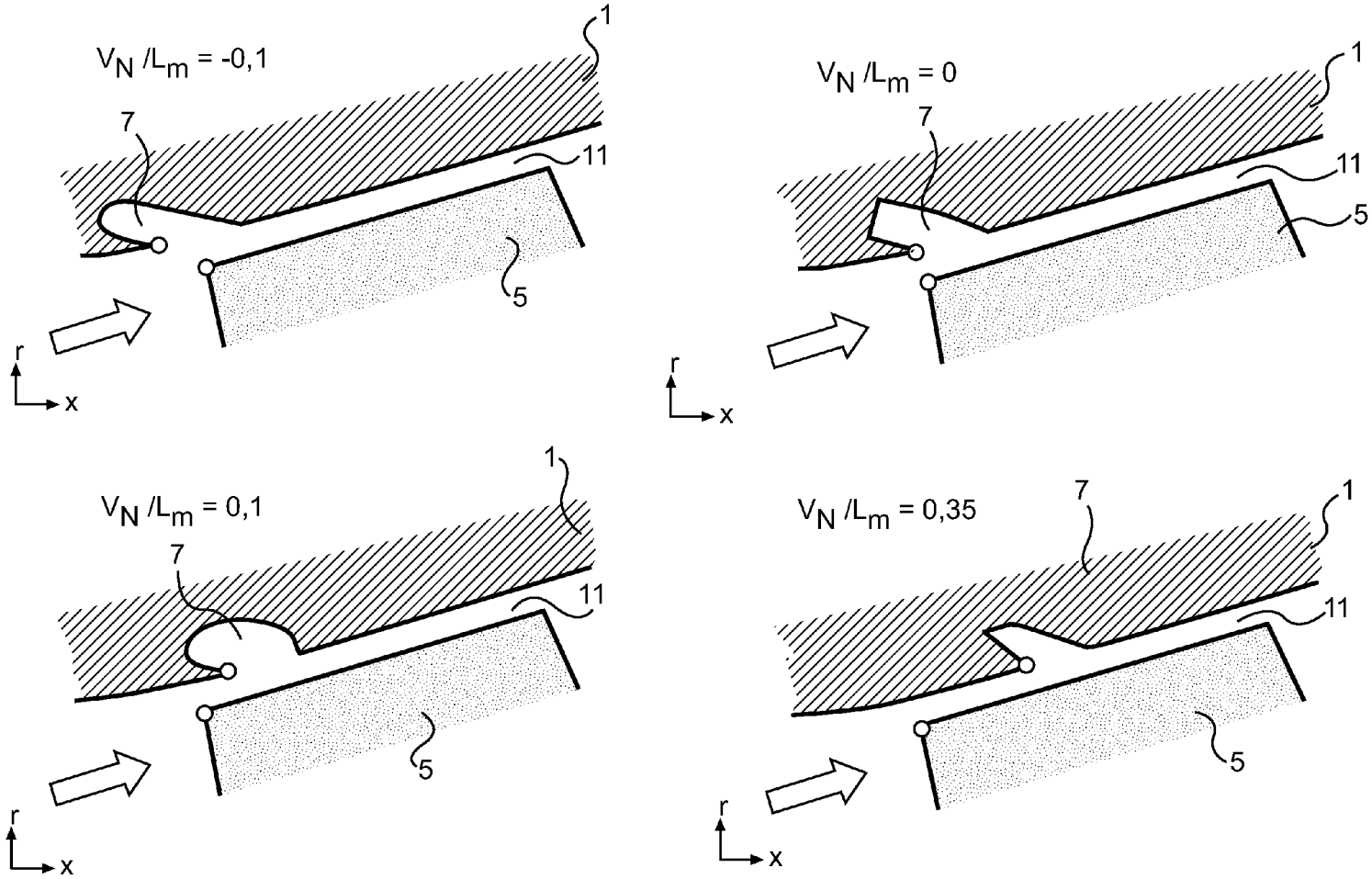
Figure 4C:
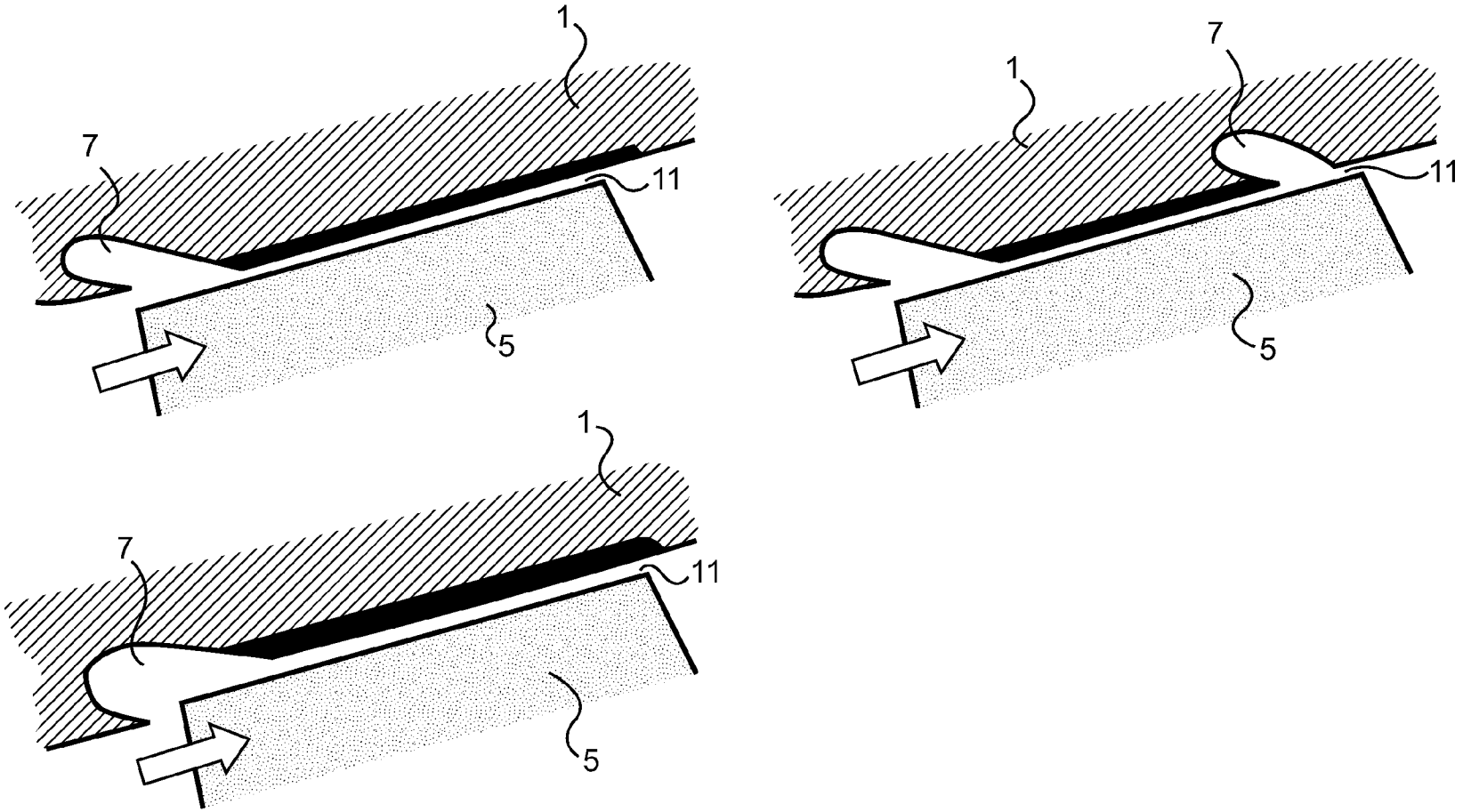
Figure 4D:
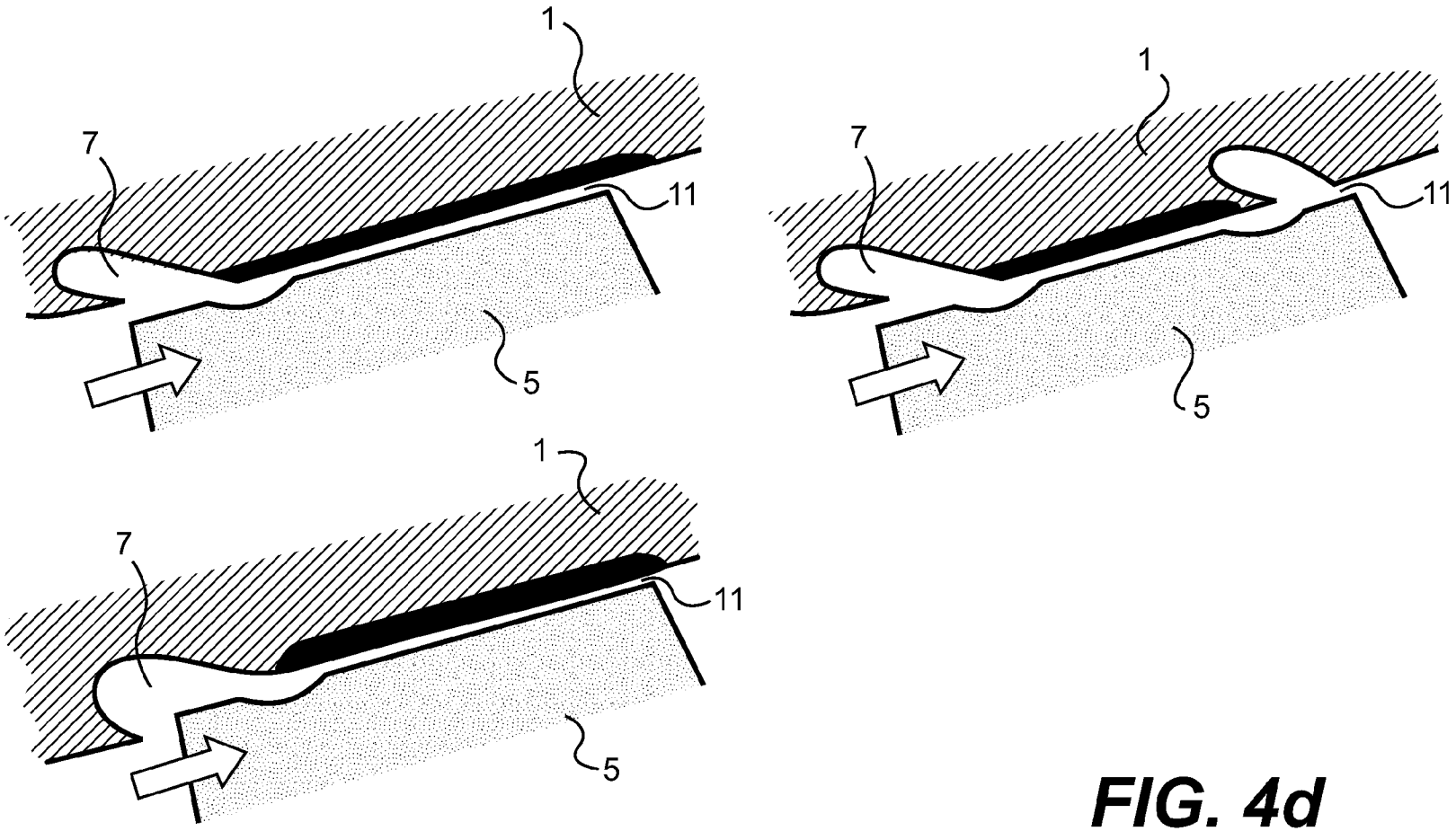
Figure 5A:
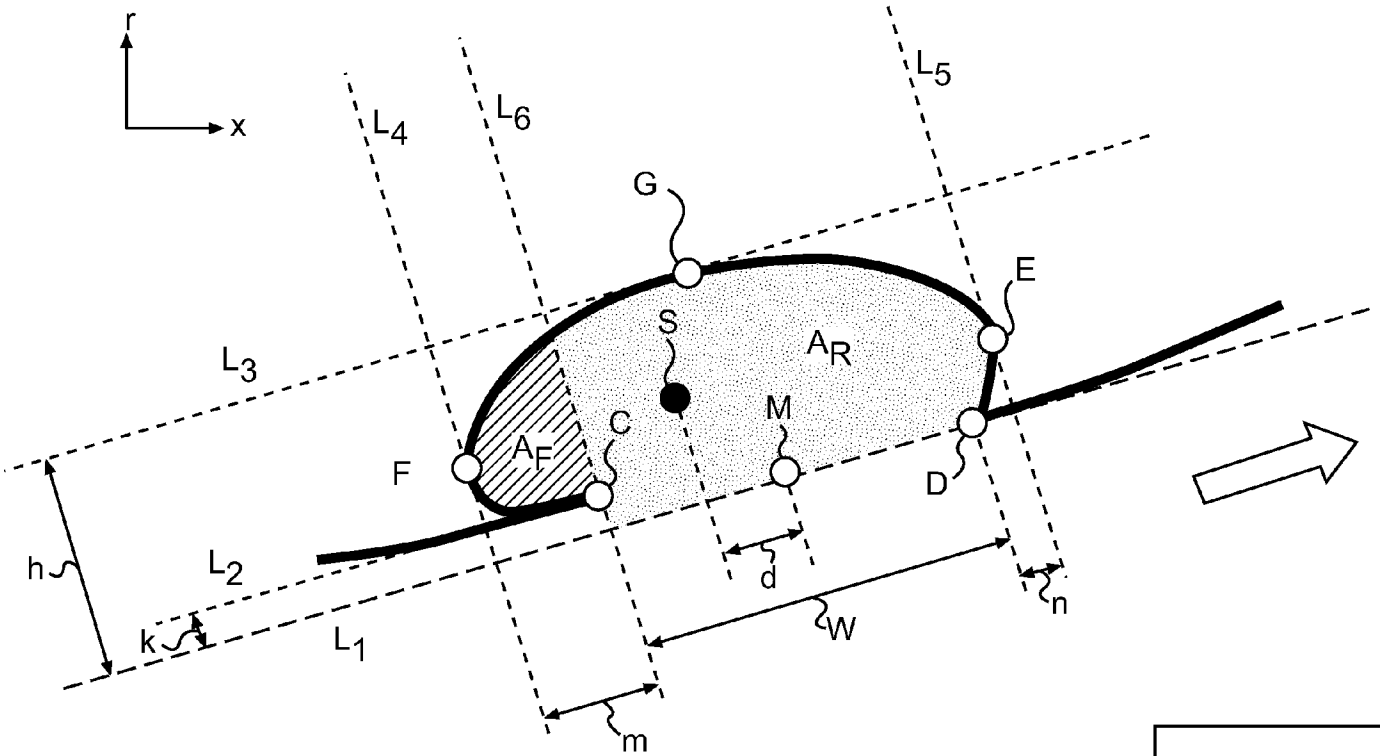
Figure 5B:
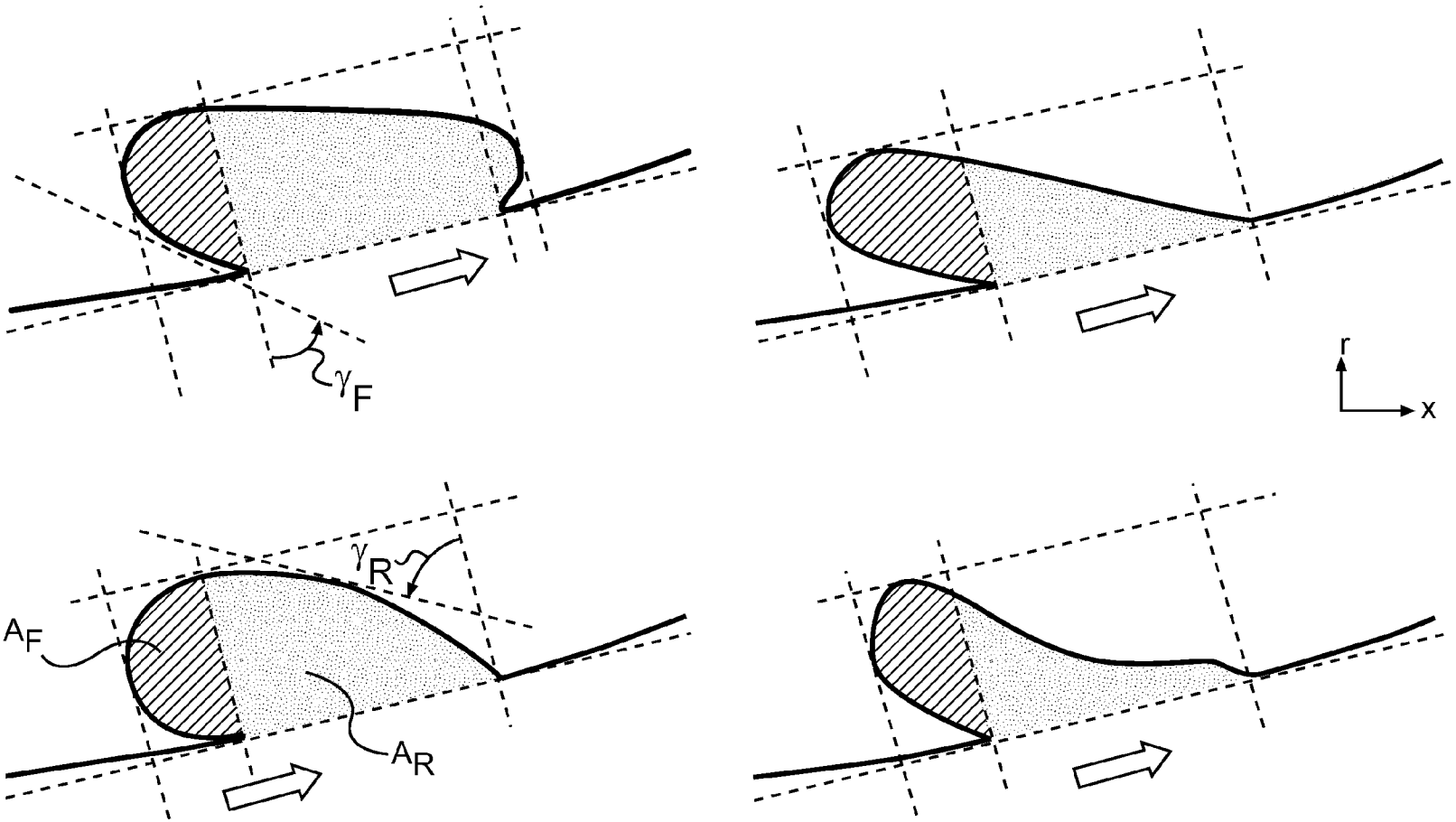
Figure 5C:
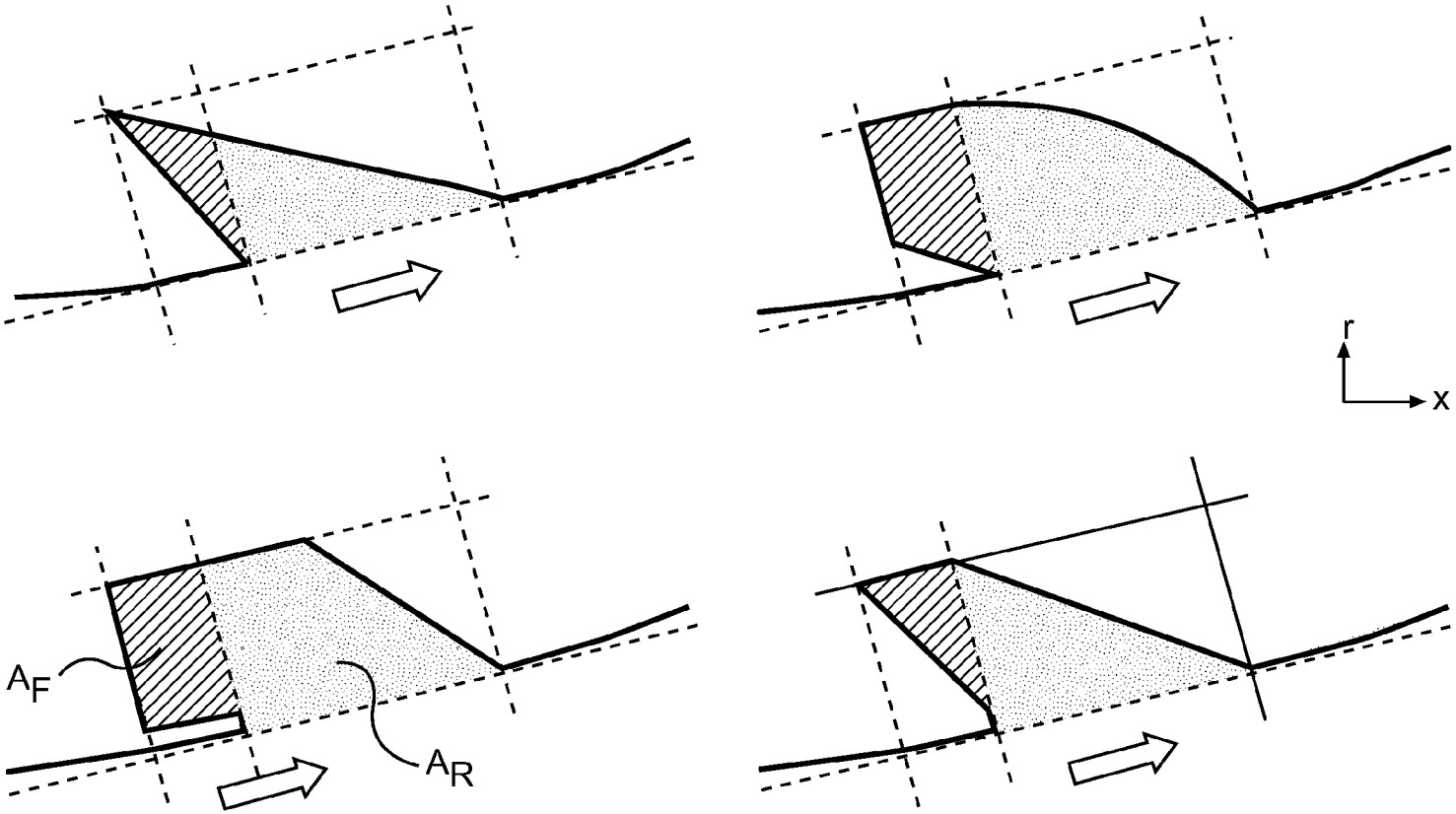
Figure 5D:
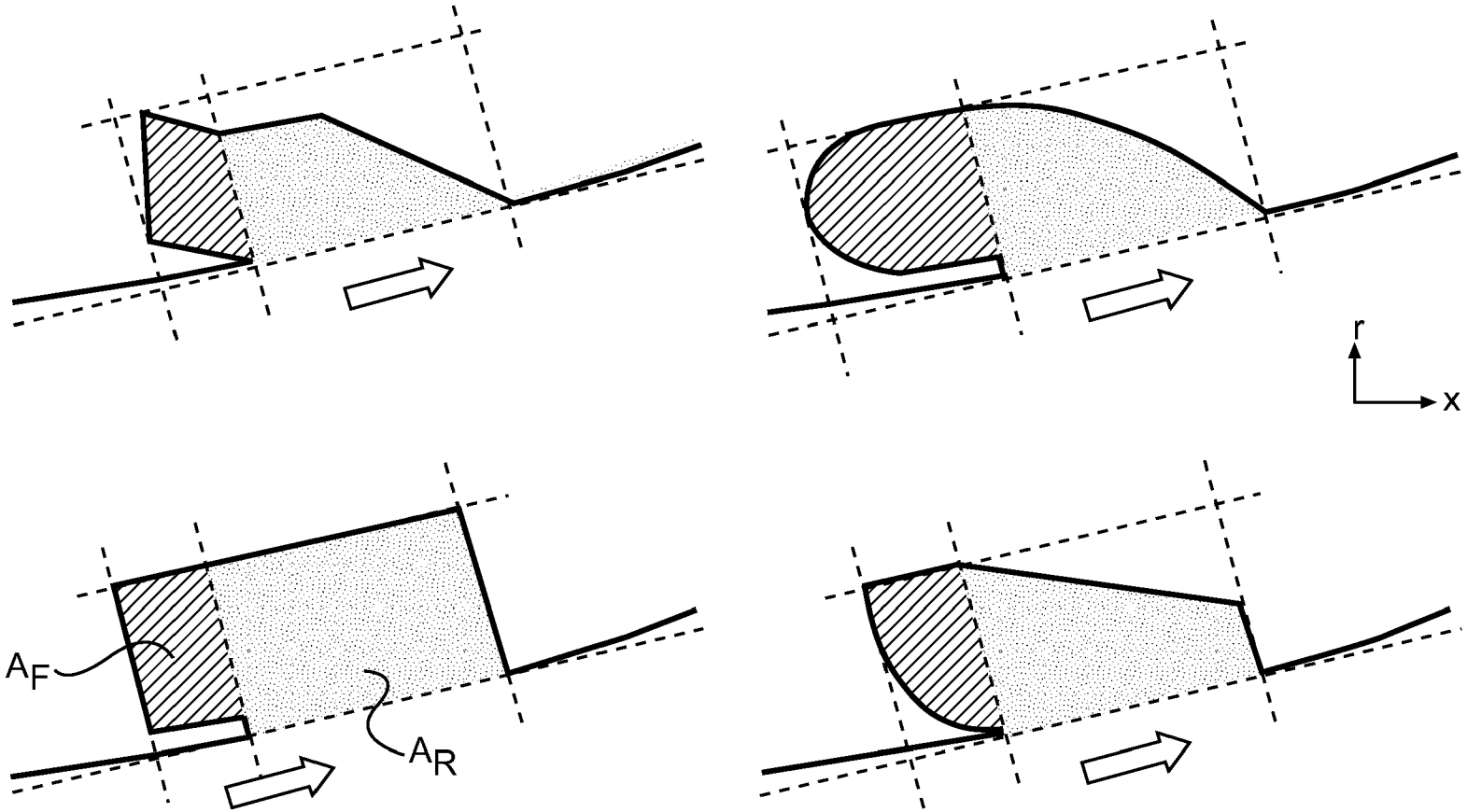
Figure 5E:
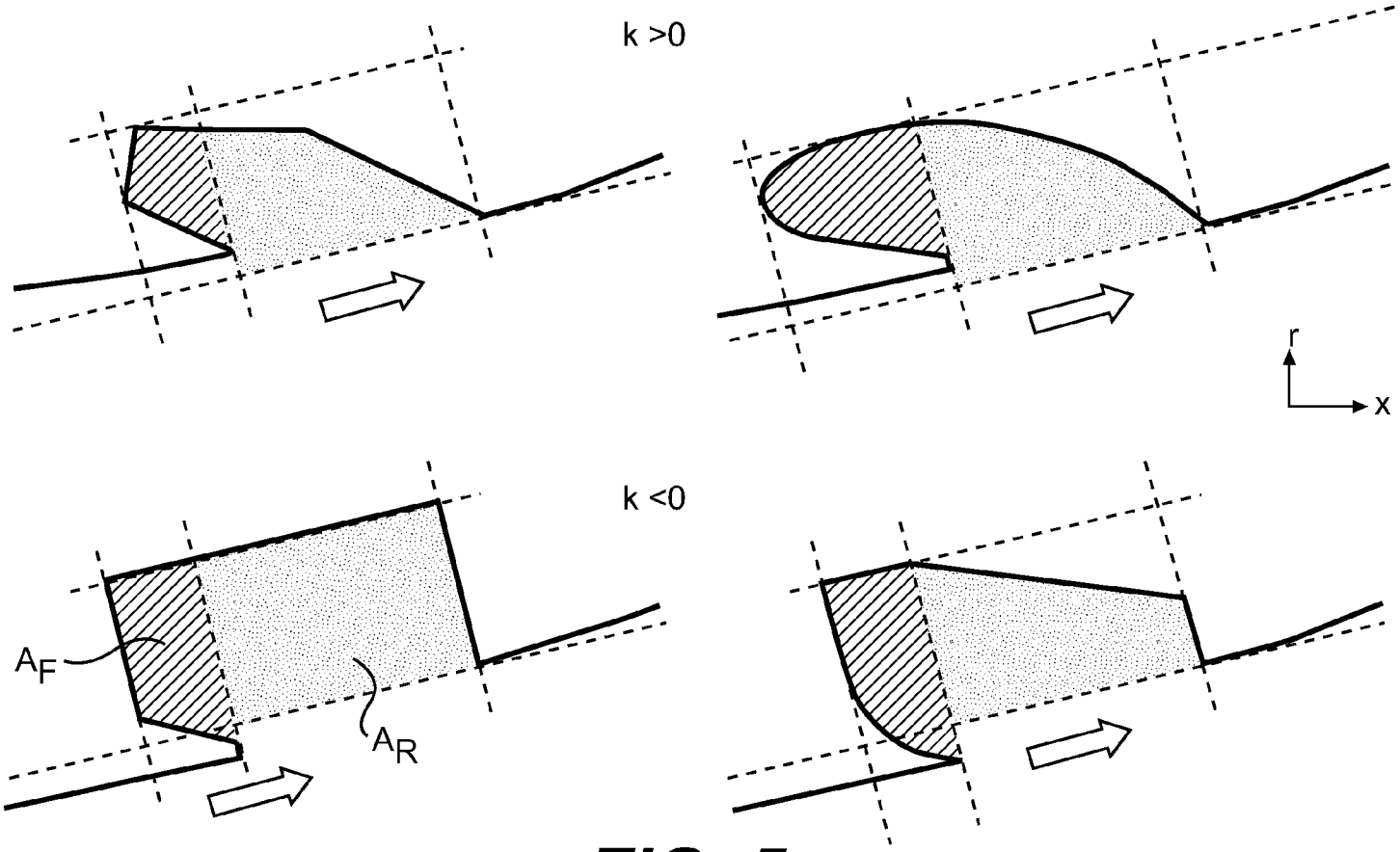
Figure 6A:
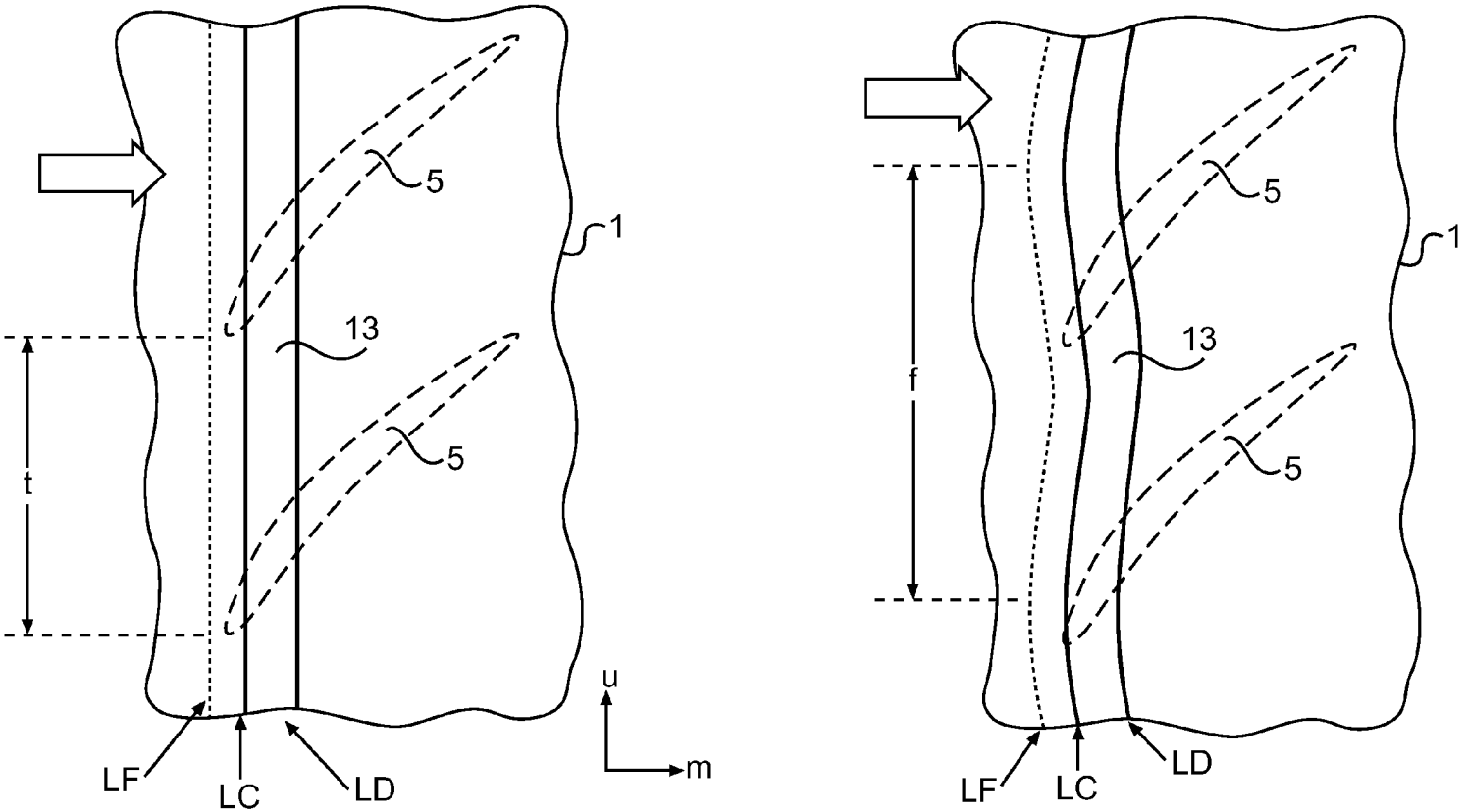
Figure 6B:
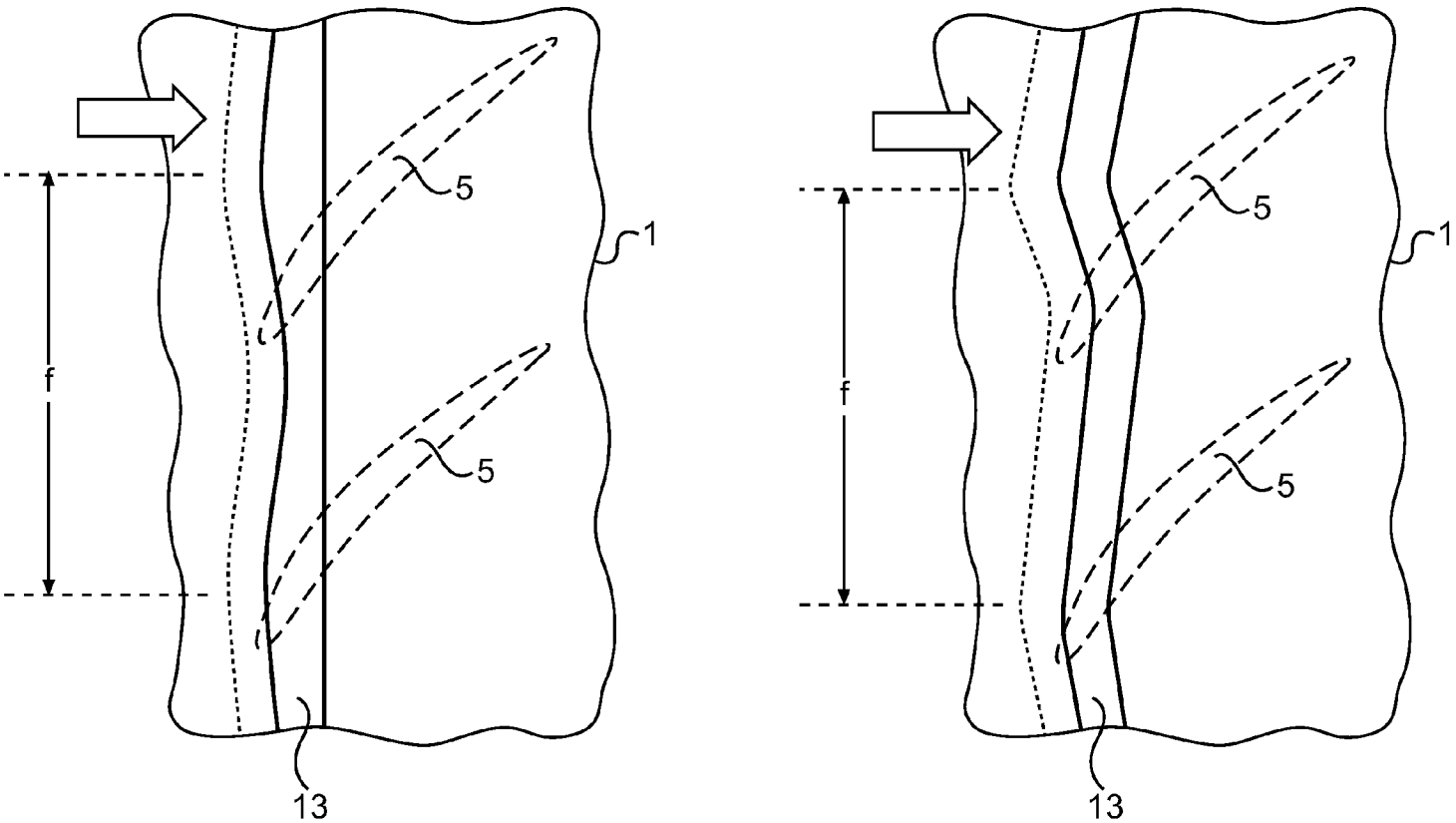
Figure 6C:
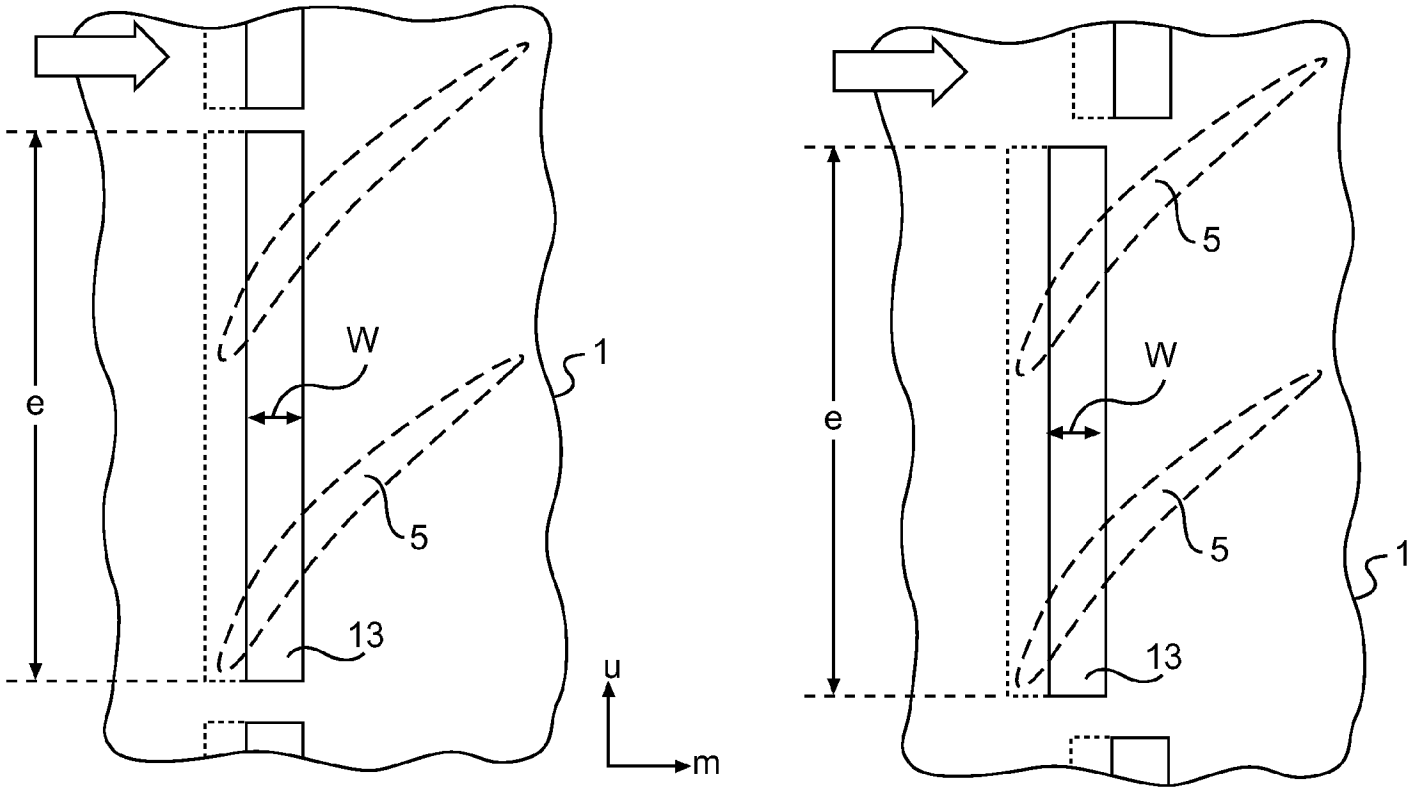
Figure 6D:
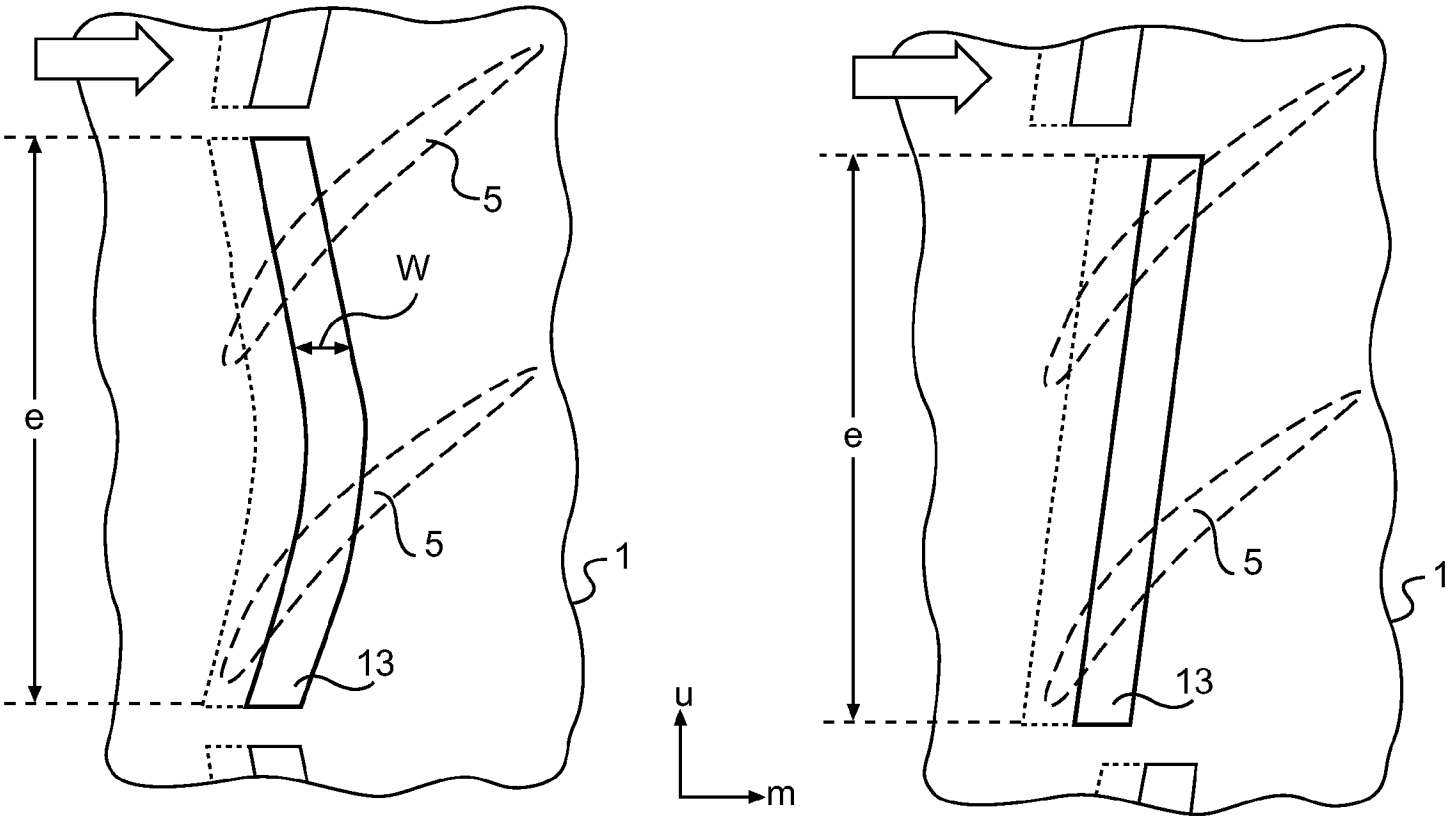
Figure 6E:
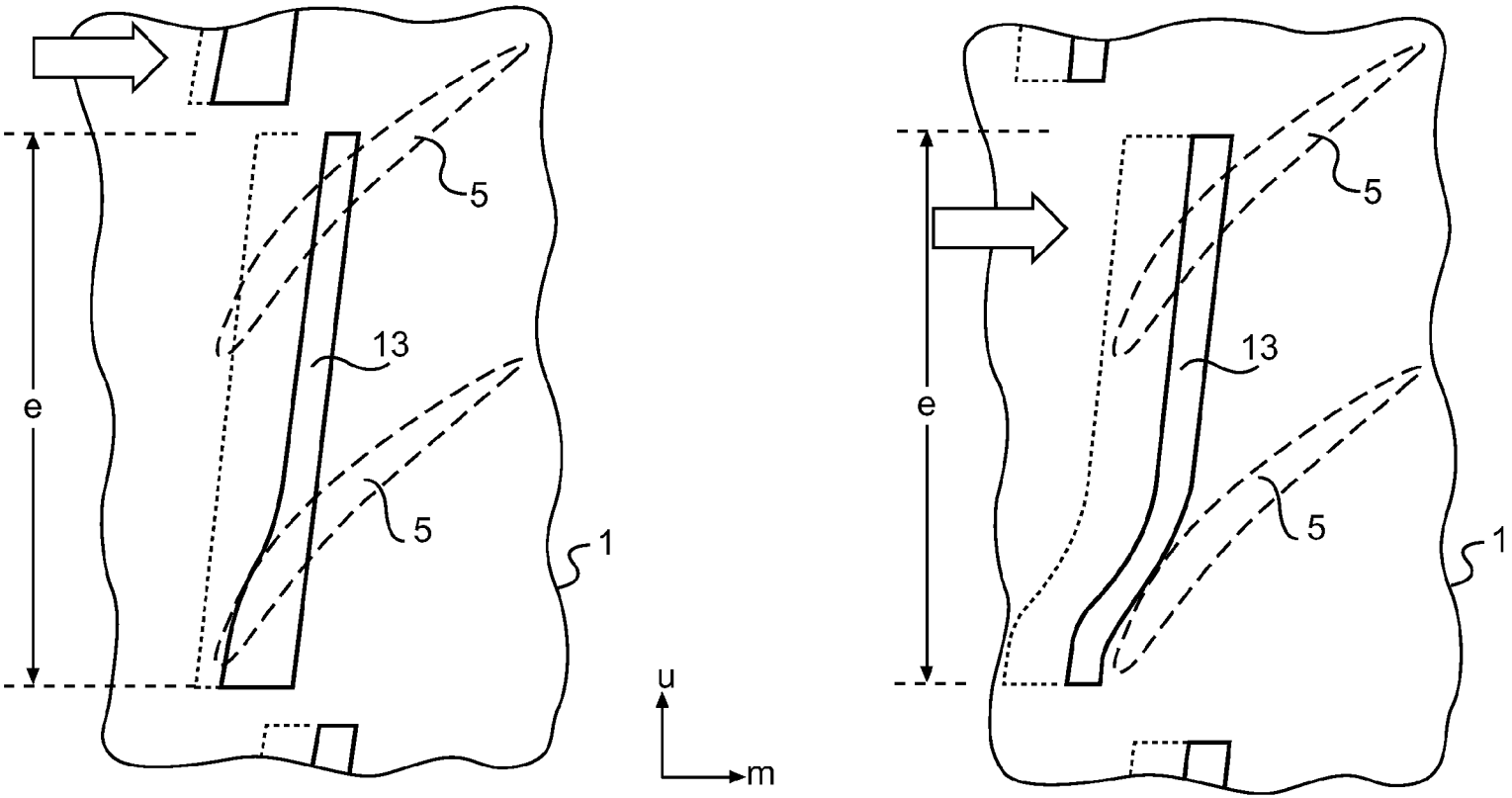
Figure 6F:
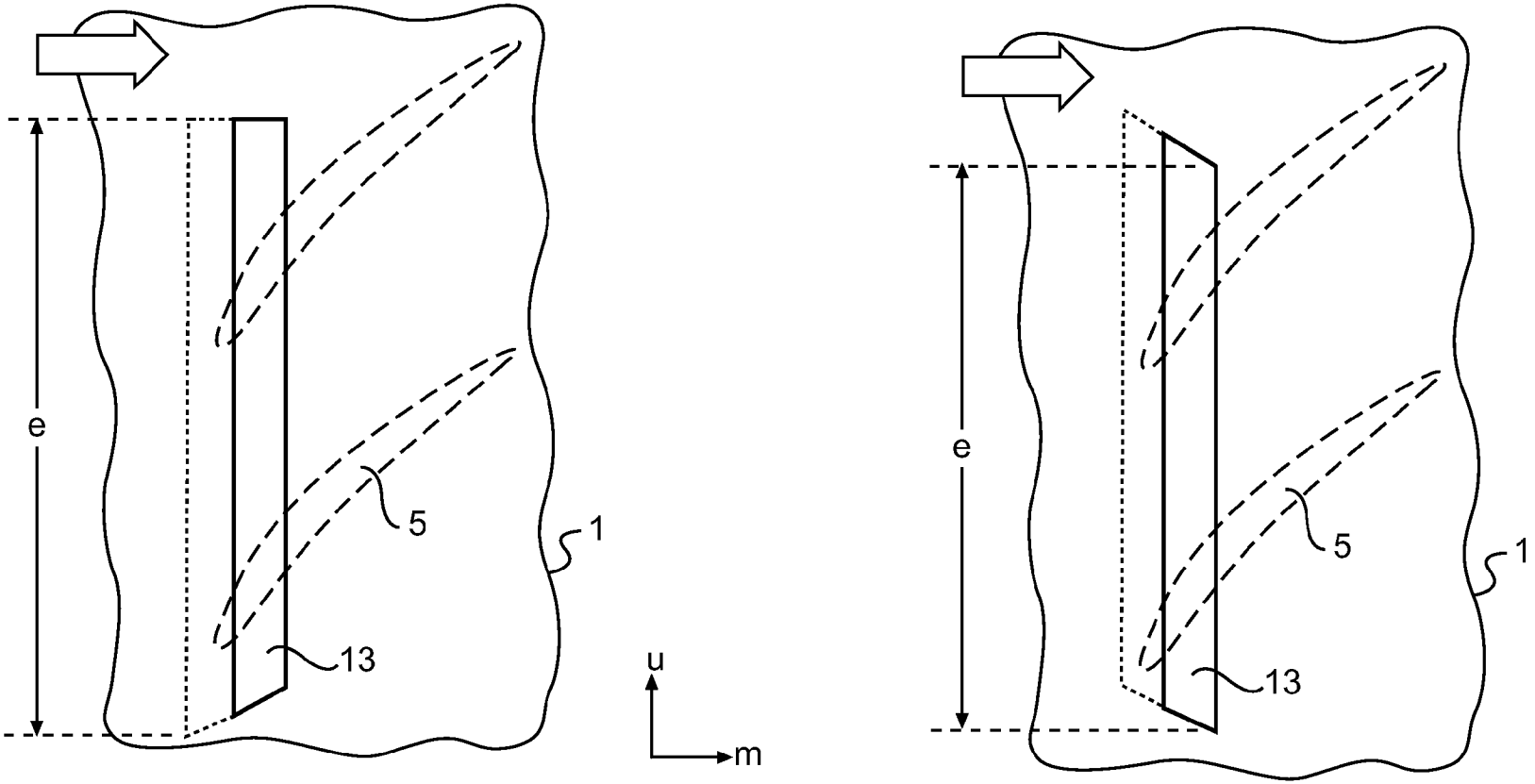
Figure 7A:
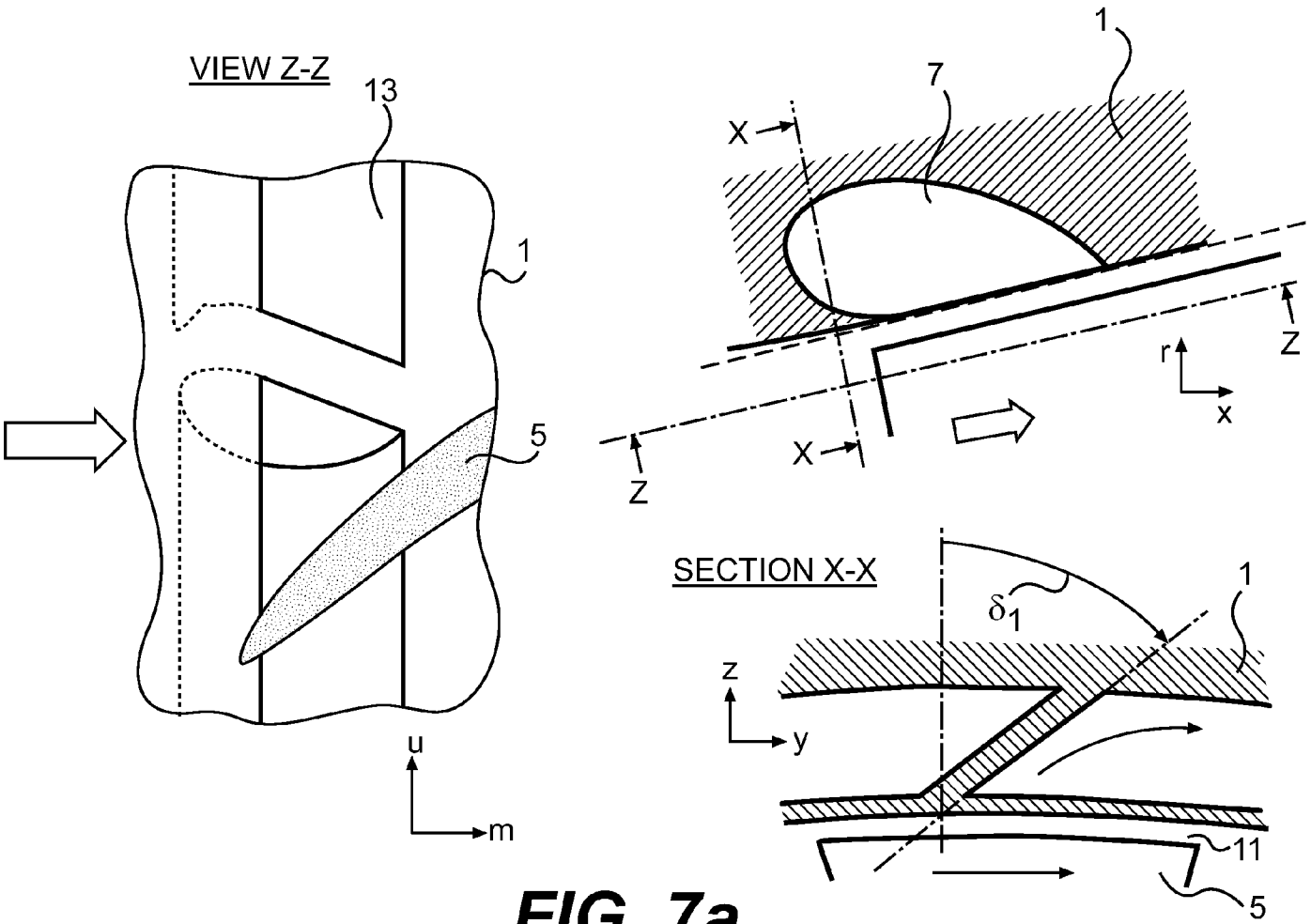
Figure 7B:
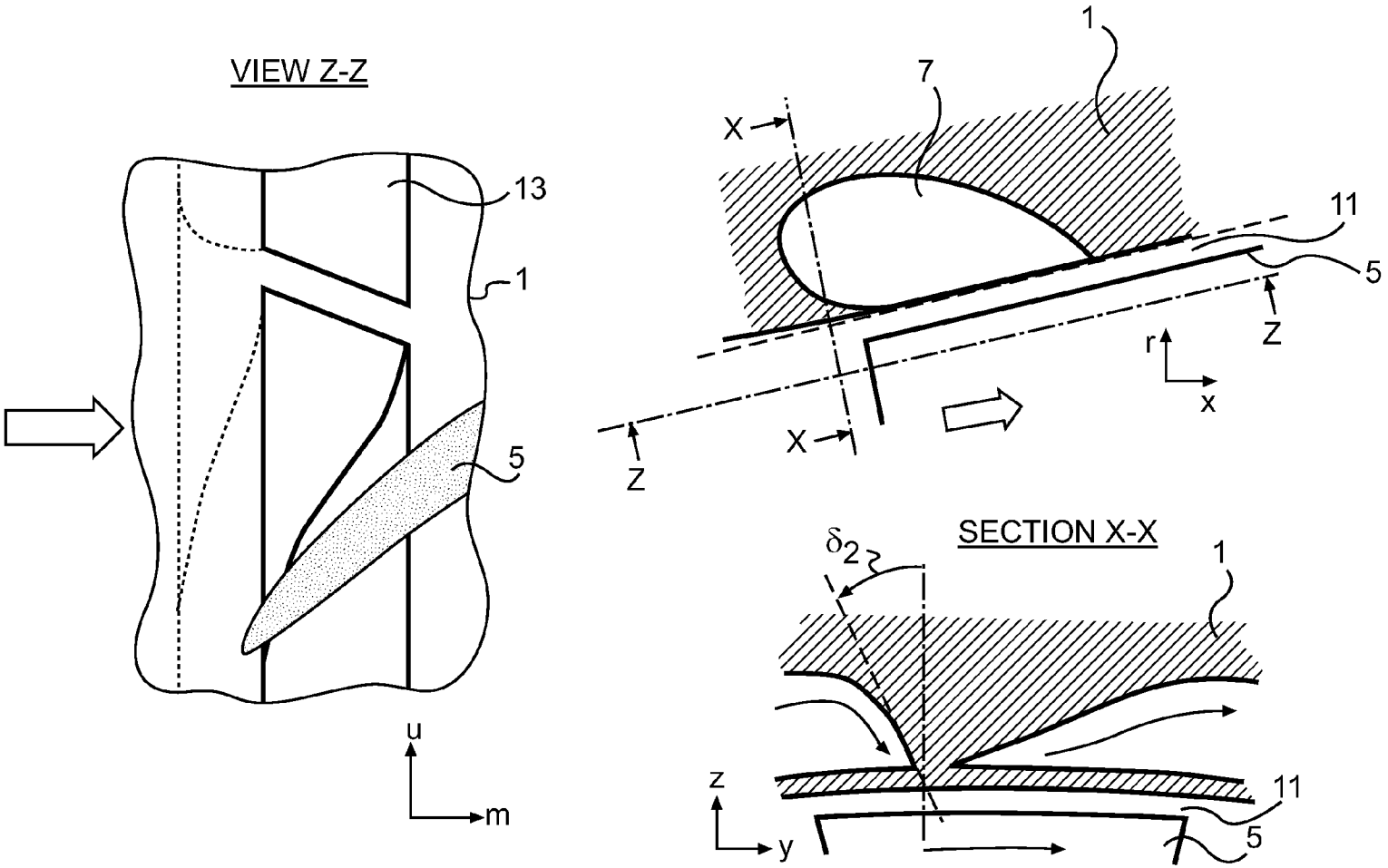
Figure 8A:
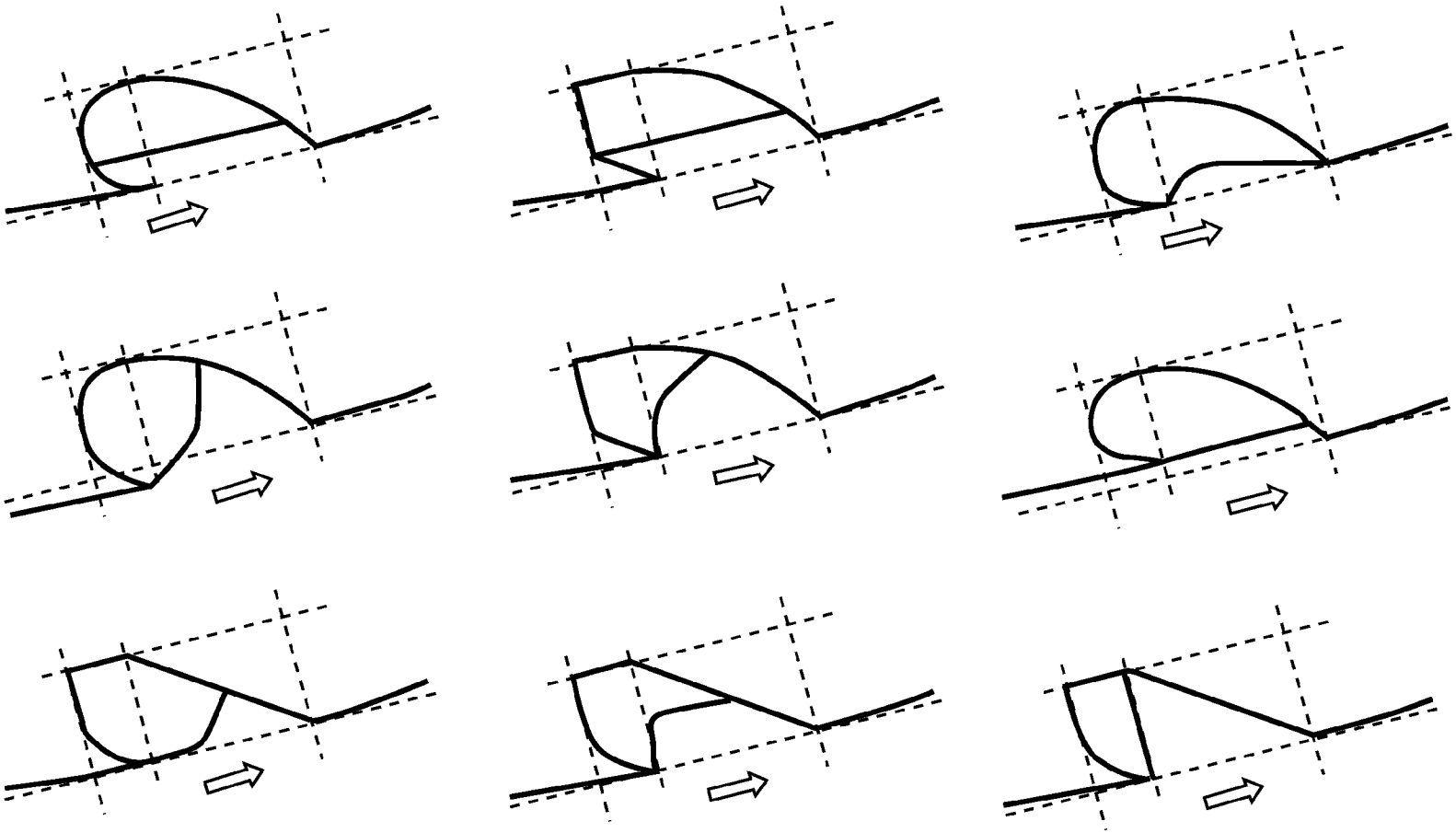
Figure 8B:
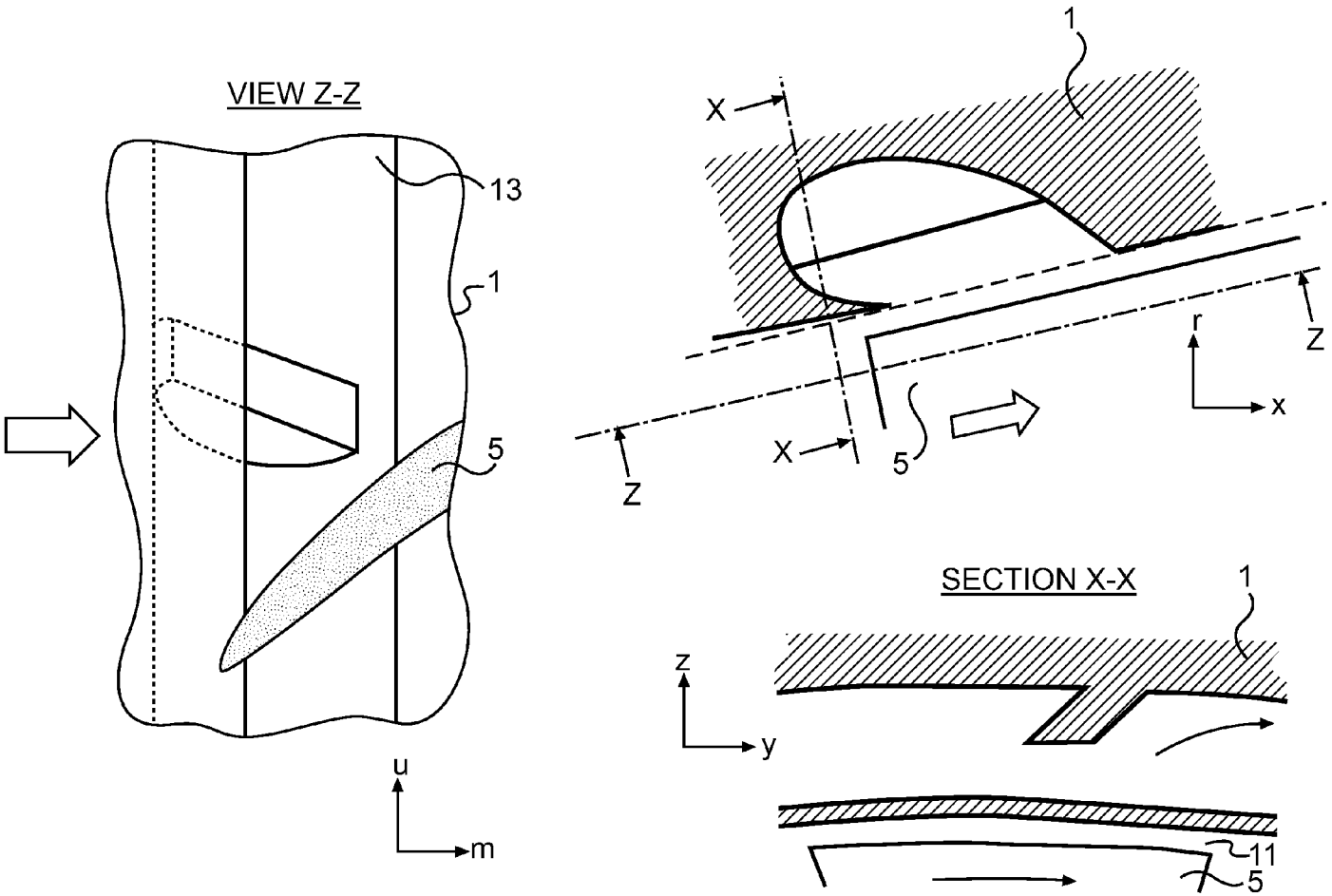
Figure 8C:
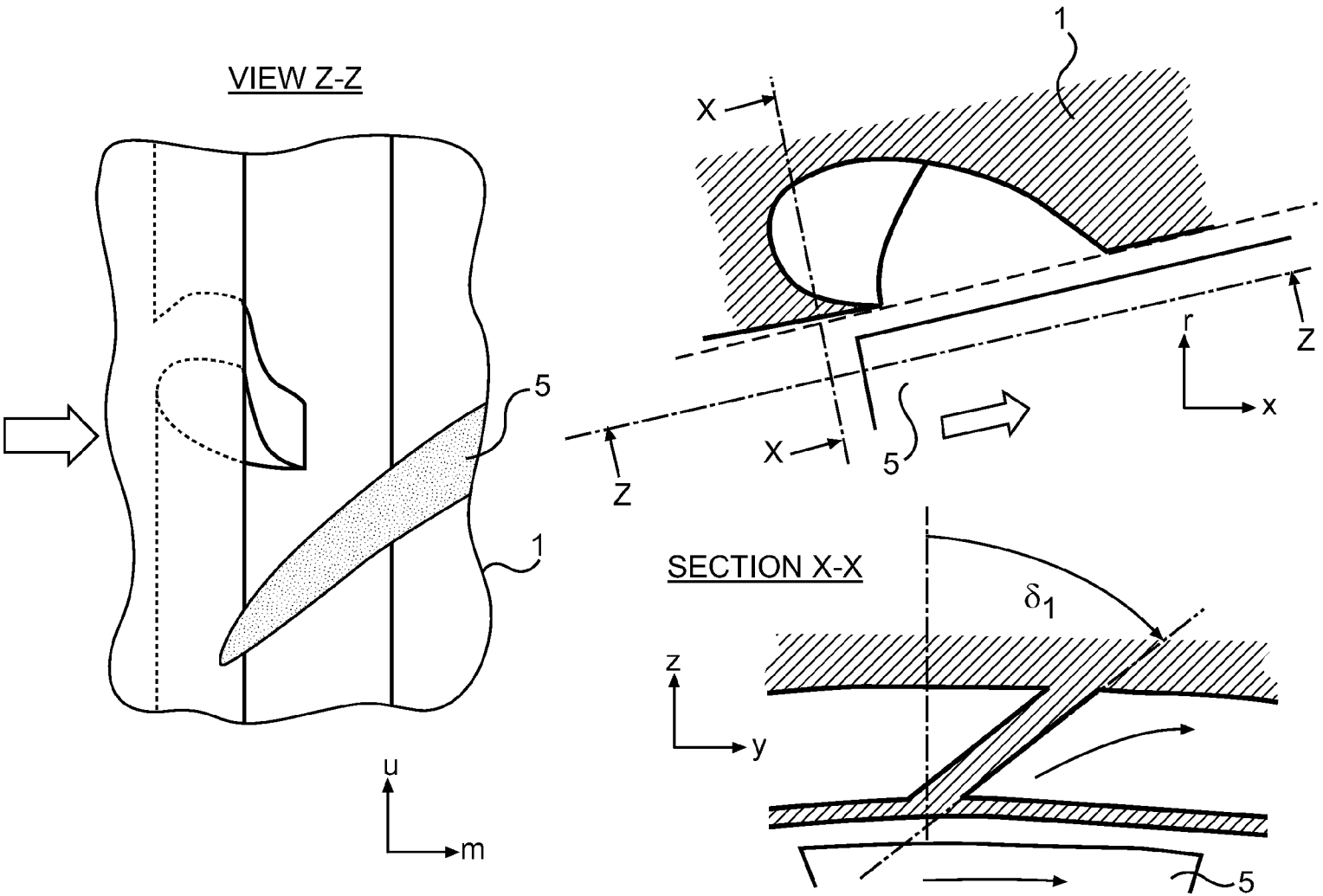
Figure 8D:
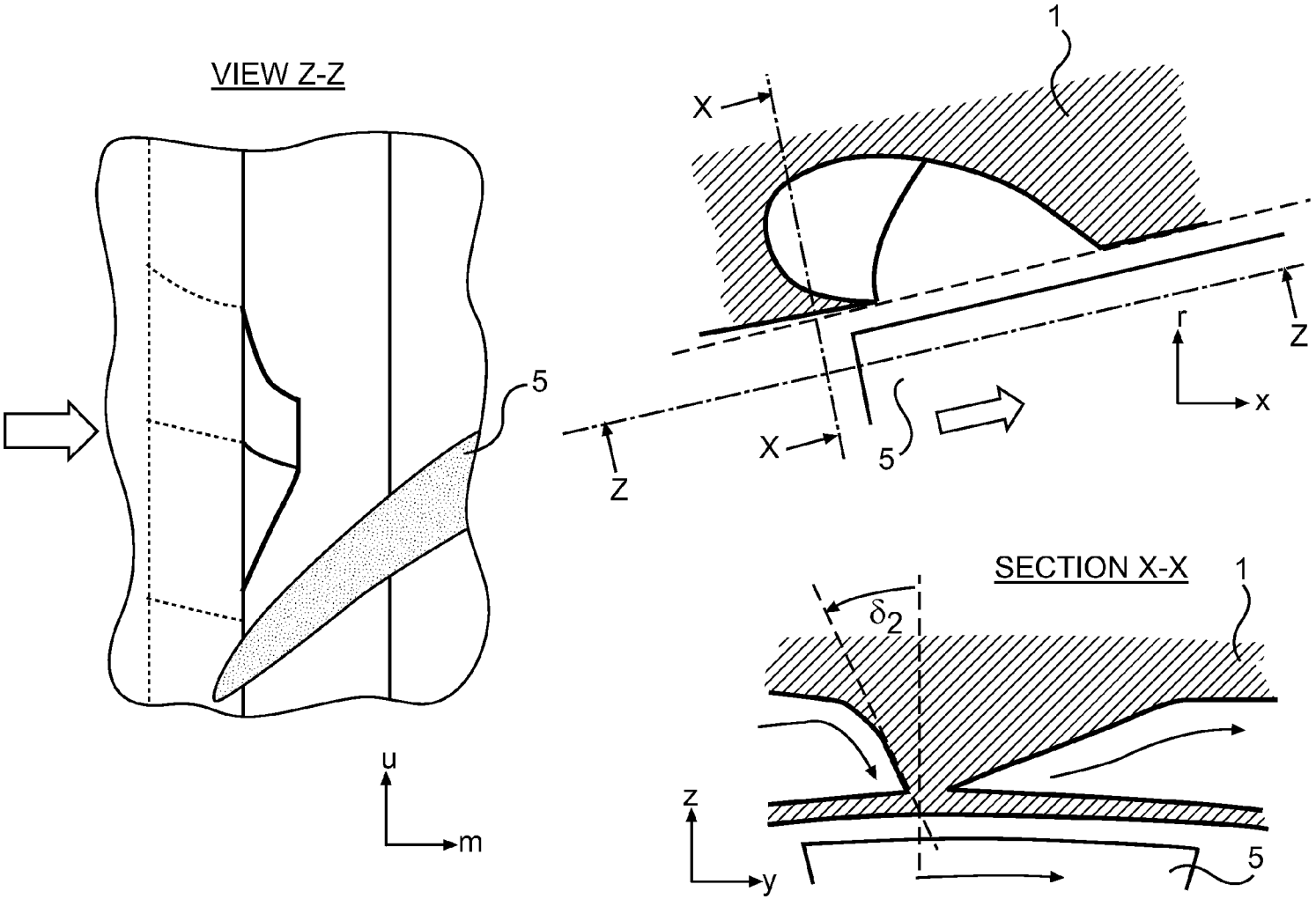
Figure 8E:
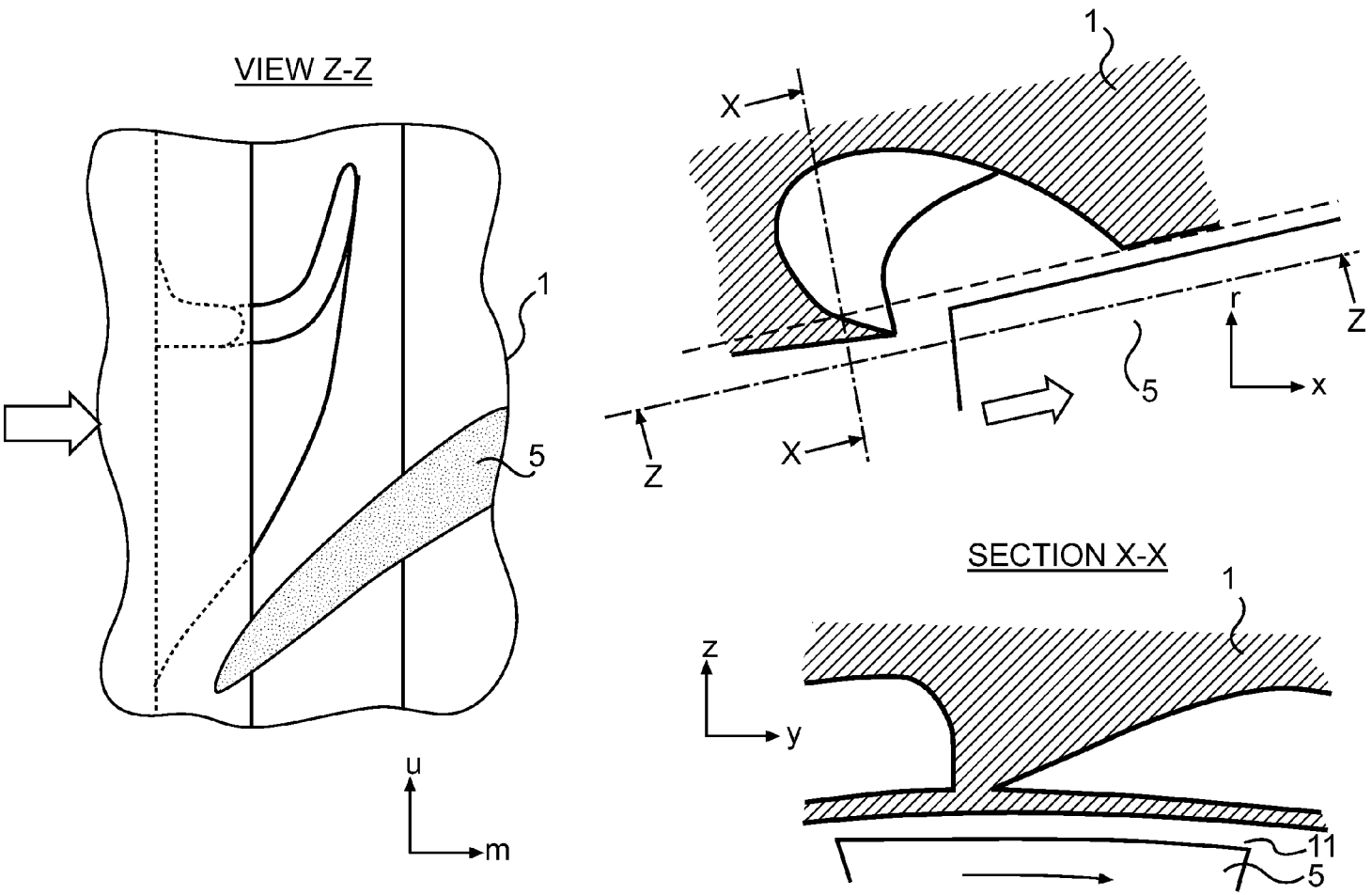

The present invention is more fully described in light of the accompanying Figures showing preferred embodiments:

FIG. 1*a* is a sketch of the state of the art, rotor casing treatment,

FIG. 1*b* is a sketch of the state of the art, rotor casing, circumferential grooves, FIGS. 2A, 2B, 2C and 2D (Prior Art) show examples of fluid flow machines relevant to the present invention, FIG. 3 shows a circumferential groove in accordance with the present invention, view in meridional section, FIG. 4*a* shows a position of the circumferential groove in meridional section in accordance with the present invention, FIG. 4*b* shows a position of the circumferential groove in meridional section in accordance with the present invention, examples, FIG. 4*c* shows a favorable embodiment in accordance with the present invention with abradable coating, FIG. 4*d* shows a favorable embodiment in accordance with the present invention with abradable coating and recess at the blade end, FIG. 5*a* shows a circumferential groove in meridional section in accordance with the present invention, characteristics, FIG. 5*b* shows circumferential groove shapes in meridional section in accordance with the present invention, FIG. 5*c* shows further circumferential groove shapes in meridional section in accordance with the present invention, FIG. 5*d* shows further circumferential groove shapes in meridional section in accordance with the present invention, FIG. 5*e* shows further circumferential groove shapes in meridional section in accordance with the present invention, FIG. 6*a* shows circumferential groove shapes in view Q-Q in accordance with the present invention FIG. 6*b* shows further circumferential groove shapes in view Q-Q in accordance with the present invention, FIG. 6*c* shows further circumferential groove shapes in view Q-Q in accordance with the present invention, FIG. 6*d* shows further circumferential groove shapes in view Q-Q in accordance with the present invention, FIG. 6*e* shows further circumferential groove shapes in view Q-Q in accordance with the present invention, FIG. 6*f* shows further circumferential groove shapes in view Q-Q in accordance with the present invention, FIG. 7*a* shows a circumferential groove with interruption in accordance with the present invention FIG. 7*b* shows a circumferential groove with shaped interruption in accordance with the present invention, FIG. 8*a* shows circumferential grooves with internal deflecting means, meridional view, in accordance with the present invention, FIG. 8*b* shows a circumferential groove with internal deflecting means (parallel) in accordance with the present invention, FIG. 8*c* shows a circumferential groove with internal deflecting means (oblique) in accordance with the present invention, FIG. 8*d* shows a circumferential groove with internal deflecting means (oblique and contoured) in accordance with the present invention, FIG. 8*e* shows a circumferential groove with internal deflecting means (oblique and profiled) in accordance with the present invention.

FIG. 3 shows the inventive solution of a blade row 5 with free end and running gap 11 as well as a groove 7 extending in the circumferential direction in the area of the running gap 11, represented in the meridional plane set up by the axial direction x and the radial direction r.

The running gap 11 separates the blade tip from a component appertaining to the main flow path on the hub 3 or the casing 1 of the fluid flow machine.

A rotary relative movement exists between the blade tip and the component appertaining to the main flow path. The representation therefore similarly applies to the following arrangements:

1.) Rotary blade on stationary casing,
2.) Stationary blade on rotary hub,
3.) Stationary blade on rotary casing,
4.) Rotary blade on stationary hub.

The main flow direction is indicated by a bold arrow. Upstream of the blade row with running gap, a further blade row can be disposed, as indicated here by broken lines.

The leading edge point of the blade 5 on the running gap 11 is marked A and the trailing edge point of the blade on the running gap is marked B.

The aperture 12 of the groove 7 on the confinement of the main flow path is limited by the starting point C and the terminating point D. Starting out from the groove aperture 12, a recess withdrawn in the casing 1 or the hub contour, respectively, is provided which is inclined in the upstream direction. According to the present invention, the circumferential extension of the groove 7 is large as compared to the extension of the groove 7 in the meridional flow direction. The groove 7 according to the present invention can accordingly be provided on the entire circumference of the machine or only on part of the circumference.

The shape of the inventive groove 7 selected in this representation is to be deemed exemplary and representative of a number of groove shapes with upstream inclination falling within the scope of the present invention and being explained in more detail in further Figures.

Also advantageous according to the present invention is the trivially derivable solution of a multiple arrangement of grooves 7 according to the present invention in the area of a blade end with gap. Such an arrangement is shown in FIG. 3 by way of example of two further grooves 7 (here shown in phantom). However, for simplicity, further Figures and views have hereinafter been reduced to one groove 7 only.

Finally, the representation also includes the view Q-Q which is used in further representations of solutions according to the present invention.

FIG. 4*a* shows, in enlarged representation, the groove 7 according to the present invention, again in the meridional plane set up by the axial direction x and the radial direction r. The illustration is reduced to the contour of the groove 7, the relevant portion of the main flow path confinement, and a blade end with gap 11. Also illustrated are the corner points of the blade end A and B as well as the groove aperture starting point C and the groove aperture terminating point D.

The broken line through the blade tip corner points A and B specifies the reference direction for further characteristics of a groove according to the present invention. All further broken auxiliary lines indicated extend either parallelly or vertically to the reference line A-B. For example, a parallel to A-B runs through the groove aperture terminating point D. Also, one vertical to A-B runs through the groove aperture starting point C and one through the centroid S of the groove cross-sectional area situated outside of the main flow path, respectively.

The groove aperture center M is defined as a point on the auxiliary line through point D, namely halfway between the points C and D in reference direction A-B.

According to the present invention, the cross-section of the groove 7 essentially deviates from the parallelogrammic shape and, due to its contour, is inclined in the upstream direction. This is ensured, among others, by the centroid S of the groove cross-sectional area being disposed upstream of the groove aperture center M by an amount of $d>0$.

The position of the groove 7 in the area of the blade end according to the present invention is established by the distance $V_N$ given between the points A and C in the reference direction A-B in relation to the meridional chord length at the blade tip $L_m$ as follows: $-0.25<V_N/L_m<0.95$. Consequently, the groove starting point can be located at max. 25 percent of the meridional blade chord length upstream of the leading edge point A and at max. 95 percent of the meridional blade chord length downstream of the leading edge point A.

Favorable in accordance with the present invention is a position as per $-0.15<V_N/L_m<0.35$. Particularly favorable in accordance with the present invention is a position as per $-0.15<V_N/L_m<0.15$.

FIG. 4*b* shows four examples of groove positions in accordance with the present invention.

FIG. 4*c* shows three examples of a groove 7 according to the present invention where a blade abradable coating is provided on the main flow path confinement in the area of the running gap. A particularly favorable solution according to the present invention includes that, as illustrated, the abradable coating is provided only within a partial section of the blade running path width, the abradable coating forms within this partial section a smooth and continuous surface on the main flow path confinement, and a groove according to the present invention confines the abradable coating in such a manner in the upstream and/or downstream direction that blade tip corner point A and/or the blade tip corner point B lie within an area which is not covered by the abradable coating. This applies to all three illustrations of FIG. 4*c*, with the top left illustration showing a groove 7 in the area of the blade leading edge, with the top right illustration showing a groove 7 in the area of the leading and the trailing edge, and with the bottom left illustration showing a groove 7 in the area of the leading edge with step (with the groove aperture starting edge and the blade end here even overlapping transversely to the meridional flow direction).

FIG. 4*d* shows similar configurations with abradable coating according to the present invention, with the material of the component forming the main flow path confinement here completely bordering the abradable coating at its rims at the transitions to the groove 7. In this case, it is favorable according to the present invention to provide a recess at the blade end where the latter is directly opposite to the material of the component forming the main flow path confinement to preclude local rubbing of the blade end.

FIG. 5*a* shows, in enlarged representation, the groove 7 according to the present invention with definition of its characteristics, again in the meridional plane set up by the axial direction x and the radial direction r. The groove 7 according to the present invention is defined by an arrangement of six auxiliary lines to which certain conditions apply. The auxiliary lines extend either parallel or vertically to the reference direction A-B:

Line L1 extends parallelly to A-B through the groove aperture terminating point D.

Line L2 extends parallelly to L1 through the groove aperture starting point C.

Line L3 extends parallelly to L1 and tangentially along the groove contour, so that, in accordance with the present invention, it has at least one point G in common with L3 at a position with maximum penetration depth h.

Line L4 extends vertically to L1 and tangentially along the groove contour, so that, in accordance with the present invention, it has at least one point F in common with L4 at a position with maximum upstream overhang m.

Line L5 extends vertically to L1 and tangentially along the groove contour, so that, in accordance with the present invention, it has at least one point E in common with L5 at a position with maximum downstream overhang n.

Line L6 extends vertically to L1 through the groove aperture starting point C and, in accordance with the present invention, divides the cross-sectional area of the groove into two partial zones: the zone AF situated upstream of L6 (bold hatching) and the zone AR situated downstream of L6 (thin hatching).

Marked here again as point S is the centroid of the groove total cross-sectional area (AF+AR), as are the groove aperture center M and the distance d provided between S and M.

The distances k, h, m, n, d are signed positive in the marked direction of arrow.

Finally, for a groove according to the present invention, the following further characteristics jointly apply:

$$w/L_m<0.2$$

$$h/w<10$$

$$m/w>0.1$$

$$A_F/A_R>0.1$$

$$d/w>0.05$$

$$\text{amount}(k/w)<2$$

FIG. 5*b* exemplifies, in enlarged representation, four groove shapes which are possible in accordance with the present invention in the meridional plane set up by the axial direction x and the radial direction r. For better orientation, the auxiliary lines described in FIG. 5*a* have been indicated again. Also included in each part of the Figure are the hatched partial zones of the groove. It is apparent that, within the above definition of the groove in meridional view according to the present invention, different shapes may be provided consisting of a combination of straight and curved contour sections.

Particularly advantageous here is a groove contour which, in the area of the partial zone $A_F$, is at least sectionally oriented in the upstream direction ($0°<\gamma_F<90°$), see FIG. 5*b*, top left.

It is particularly favorable if the inclination angle of the groove contour at the partial zone $A_F$ at least sectionally assumes values ranging between 15° and 55° ($15°<\gamma_F<55°$). This applies in particular to the contour inclination at the groove aperture starting point C.

Further advantages are obtained if the groove contour at the partial zone $A_F$ is rectilinear or concave (as referred to the groove interior).

Also advantageous here is a groove contour which, in the area of the partial zone $A_R$, is at least sectionally oriented in the upstream direction ($0°<\gamma_R>90°$), see FIG. 5*b*, bottom left.

It is particularly favorable if the inclination angle of the groove contour at the partial zone $A_R$ at least sectionally assumes values ranging between 15° and 55° ($15°<\gamma_R<55°$). This applies in particular to the contour inclination at the groove aperture terminating point C.

Further advantages are obtained if the groove contour at the partial zone AR is rectilinear or concave (in relation to the groove interior).

FIGS. 5*c* and 5*d* each exemplify, in enlarged representation, four other groove shapes in the meridional plane, which are possible in accordance with the present invention. Here, the groove contour is formed by either a pure polygon curve or a combination of circular arc and polygon curve.

While FIGS. 5*a* to 5*c* show examples of grooves according to the present invention where the groove aperture starting point C and the groove aperture terminating point D are on the same auxiliary line (i.e. offset k being zero), FIG. 5*e* shows examples of groove configurations with positive or negative offset k according to the present invention.

FIG. 6*a* shows two solutions of a groove according to the present invention in view Q-Q marked in FIG. 3. Shown is a view on the surface of the main flow path confinement in the plane set up by the circumferential direction u and the meridional direction m. Illustrated here is only a breakout of the main flow path confinement developed into the drawing plane. The profiles of two adjacent blade ends of the blade row are shown by broken lines. The main flow is from the left to right-hand side, as indicated by the bold arrow.

The left part of FIG. 6*a* shows a groove 7 according to the present invention which is provided exactly circumferentially in the main flow path confinement and with uniform groove cross-sectional shape along the entire circumference of the machine. The lines established by the groove aperture starting points C and the groove aperture terminating points D are correspondingly marked LC and LD. The hidden edge resulting from the connection of all groove frontal points F is marked LF and traced dotted. The parallel course of the three lines LF, LC and LD provided along the entire circumference is the simplest variant of the solution according to the present invention. The distance of two adjacent blades, the so-called blade pitch, directly at the gap has the amount t, as also indicated in the Figure.

The right part of FIG. 6*a* shows a groove 7 according to the present invention in the form of a circumferential groove 13 which, while being provided essentially circumferentially in the main flow path confinement and with uniform groove cross-sectional shape along the entire circumference of the machine, features, according to the present invention, a circumferentially varying position of the groove relative to the blade end in the meridional direction m. Particularly favorable are groove courses recurring at a stated period f. The course of the groove can, as shown here, have an undulatory form similar to a sinusoid.

Furthermore, as shown in the left part of FIG. 6*b*, it can be favorable according to the present invention to allow only one or two of the three lines LF, LC and LD to take an undulatory course, in which case the cross-sectional shape of the groove will accordingly vary along the circumference (within the limits of the present invention). In accordance with the present invention, it can be advantageous in aerodynamic, design or manufacturing engineering terms to allow at least one of the three lines LF, LC and LD to take a polygon-curve or zagged course, respectively, see right-hand side of FIG. 6*b*. Also advantageous here, as with the above-described grooves according to the present invention, is a periodic recurrence of a groove section, and, in particular, a periodic recurrence of a groove section at an integer divisor or at an integer multiple of the blade pitch t.

Also falling within the scope of the present invention is an extension of the groove which is interrupted in the circumferential direction.

FIG. 6*c* shows examples of an interrupted and an interrupted and offset course of the groove, with the rims of the interruption being oriented essentially in the meridional direction m. According to the present invention, the configurations shown satisfy the condition that the circumferential extension e of a single groove must be distinctly larger than the (possibly circumferentially varying) width w of the groove aperture, thus providing for a circumferentially slender form of the groove. Here, it is particularly favorable if the groove length e amounts to at least the size of the blade pitch t (e/t equal to/greater than 1).

Grooves with varying (oblique, curved or undulating) course of the lines LF, LC and/or LD also fall within the scope of the present invention. Two examples thereof are shown in FIG. 6*d*.

FIG. 6*e* shows two further examples of the course of an interrupted groove varying along the circumference in the meridional direction.

FIG. 6*f* finally shows configurations of the groove according to the present invention in which the two rims of the groove interruption are oriented differently and also obliquely to the meridional direction.

FIG. 7*a* shows different views of a groove with interruption according to the present invention. In the Figure, top right, the groove is shown in the meridional plane, with view Z-Z and section X-X being marked. View Z-Z intersects the blade in the vicinity of the gap and provides a view on the surface of the main flow path confinement and the groove aperture. Hidden edges are shown by dotted lines. According to the present invention, the solution with groove interruption here shown includes an inclination of the interrupting wall in the circumferential direction. This becomes particularly apparent from section X-X (see FIG. 7*a*, bottom right). Section X-X shows the case of a main flow path confinement (casing) being concave in this view, with the pertinent relative direction of movement of the blade end being indicated by an arrow. It is understood that, according to the present invention, the characteristics of the groove interruption shown also apply to the case of a convex main flow path confinement (hub) which is not shown here. In an advantageous embodiment, the interrupting wall can, as shown here, be circumferentially inclined such that, beginning at the main flow path, a slant towards the bottom of the groove in the direction of the relative movement of the blade end is provided. Thus, a flow in the running direction of the blade is allowed to enter the groove with less disturbance. Particularly advantageous in accordance with the present invention are inclination angles at the main flow path, δ1, which are greater than 45°.

FIG. 7*b* shows, equivalently to FIG. 7*a*, a further advantageous configuration of the groove interruption. The two sides of the groove interruption have a specially contoured shape, as a result of which the groove interruption in section X-X distinctly deviates from the simple, web-style shape such that the side of the interruption pointing in the (relative) running direction of the blade end flatly and possibly curvedly approaches the bottom of the groove, while maintaining values of δ1>45°, and the side of the interruption pointing against the (relative) running direction of the blade end, starting out from the main flow path, first steeply and then roundedly approaches the bottom of the groove. Here, values of the inclination angle at the main flow path, δ2, ranging between 25° and −25° are particularly favorable.

FIG. 8*a* shows, in meridional view, nine examples of possible groove configurations with internal deflectors covered by the present invention. In accordance with the present invention, the internal deflector initially is an obstacle within the groove which impairs a circumferentially undisturbed and continuous flow in a part of the groove cross-section and, by virtue of its shape, effects a deflection or diversion of the flow. According to the present invention, the free edge of the internal deflector either is arranged completely within the groove (i.e. it does not protrude beyond a rectilinear connection of the starting and terminating point of the groove aperture, C and D, in the direction of the main flow) or is tangential with the rectilinear connection between the points C and D in a part of its course.

FIG. 8*b* provides, in three views, a detailed representation of a groove with internal deflectors according to the present invention. Top right, the meridional view is provided showing the groove in cross-section. Arranged within the groove between the groove bottom and approximately half the groove depth is a deflector whose free edge here extends parallel to the auxiliary line through the point D. View Z-Z, top left in FIG. 8*b*, shows the course of the groove along part of the circumference and, within the groove, the deflector of which the rear half is visible and the front half is hidden (dotted lines). As shown in section X-X, the deflector is here a simple, circumferentially inclined web. Of course, even simpler webs without inclination also fall within the scope the present invention.

FIG. 8*c* shows a groove with internal deflectors in accordance with the present invention, which, beginning at the groove aperture starting point C, is provided obliquely and with curved course of the free edge in the upstream part of the groove. As illustrated in view Z-Z and section X-X, the web is again inclined here. As in FIG. 8*b*, a completely round groove shape without offset between the points C and D (k=0) is again exemplified here.

FIG. 8*d* shows a groove with internal deflectors in accordance with the present invention, which in meridional view is similar to the one shown in FIG. 8*c*. However, as shown in view Z-Z and section X-X, the deflector is now contoured.

FIG. 8*e* finally shows a groove with internal deflectors in accordance with the present invention, which in meridional view is similar to the one shown in FIG. 8*c*. However, a groove configuration with offset (k<0) is here exemplified. As shown in view Z-Z and section X-X, the deflector is here provided with a profile or curvature for better flow guidance/diversion.

The present invention can be described as follows:

A fluid-flow machine with a main flow path which is confined by a hub and a casing and in which at least one row of blades is arranged, with a gap being provided on at least one blade row between a blade end and a main flow path confinement, with the blade end and the main flow path confinement performing a rotary movement relative to each other, and with at least one groove having an aerodynamically favorable cross-section and extending essentially in the circumferential direction of the machine being provided in the main flow path confinement in the area of the gap along at least part of the circumference, with the extension of the groove in the circumferential direction being large as compared to the extension of the groove in the meridional flow direction, and with the cross-sectional area of the groove, in meridional view of the fluid-flow machine, essentially departing from the parallelogrammic shape and, due to its contour, being inclined in the upstream direction, with the centroid of the groove cross-sectional area being provided upstream of the center of the groove aperture on the main flow path, with the position of the at least one groove, described by the distance VN between the blade leading-edge corner point A and the groove aperture starting point C, being established by the condition $-0.25<VN/Lm<0.95$, with Lm being the meridional chord length at the blade end at the gap, with the position of the at least one groove relative to the blade leading edge being defined as follows: $-0.15<VN/Lm<0.35$, with the position of the at least one groove relative to the blade leading edge being defined as follows: $-0.15<VN/Lm<0.15$, with the at least one groove having a strongly upstream inclined shape whose characteristics are defined by a grid of six auxiliary lines in the meridional plane set up by the axial direction x and the radial direction r, with a.) all auxiliary lines extending parallel or vertically to the reference direction A-B along the blade end, b.) a line L1 extending parallel to A-B through the groove aperture terminating point D, c.) a line L2 extending parallelly to L1 through the groove aperture starting point C, d.) a line L3 extending parallel to L1 and tangentially along the groove contour, so that it has at least one point G in common with L3 at a position with maximum groove penetration depth h, e.) a line L4 extending vertically to L1 and tangentially along the groove contour, so that it has at least one point F in common with L4 at a position with maximum upstream groove overhang m, f.) a line L5 extending vertically to L1 and tangentially along the groove contour, so that in accordance with the present invention, it has at least one point E in common with L5 at a position with maximum downstream groove overhang n, g.) a line L6 extending vertically to L1 through the groove aperture starting point C and dividing the cross-sectional area of the groove into the zone AF situated upstream of L6 and into the zone AR situated downstream of L6, h.) the centroid S of the groove total cross-sectional area and the groove aperture center M featuring a distance d, i.) a groove aperture width w being given between the rim points C and D of the groove aperture, j.) an offset k being provided between the auxiliary lines L1 and L2, k.) the blade having a meridional chord length Lm at its end, and with the characteristics of the groove being established as follows:

$$w/Lm<0.2 \text{ and } h/w<10 \text{ and } d/w>0.05 \text{ and } m/w>0.1 \text{ and}$$

$$AF/AR>0.1 \text{ and amount of } (k/w)<2,$$

with the inclination angle of the groove contour $\gamma_R$ exclusively assuming values between 0° and 90° in the area of the surface AR in the section between the groove aperture terminating point D and the point G with maximum groove penetration depth, with the groove contour being linear or concave (as referred to the groove interior) in the area of the surface AR in at least one part of the section between the groove aperture terminating point D and the point G with maximum groove penetration depth, with the inclination angle of the groove contour $\gamma_R$ assuming values between 15° and 55° at the groove aperture terminating point D, with the inclination angle of the groove contour $\gamma_F$ exclusively assuming values between 0° and 90° in the area of the surface AF in the section between the groove aperture starting point C and the point F with maximum upstream extension, with the groove contour being linear or concave (as referred to the groove interior) in the area of the surface AF in at least one part of the section between the groove aperture starting point C and the point F with maximum upstream extension, with the inclination angle of the groove contour $\gamma_F$ assuming values between 15° and 55° at the groove aperture starting point C, with a blade abradable coating being provided together with the at least one groove as main flow path confinement in the area of the running gap, with the abradable coating being provided only within a section of the meridional extension of the blade running path or the running gap, respectively, and with the abradable coating being confined in the upstream and/or downstream direction by a groove such that at least one of the blade edge points A and B lies in a section not covered by abradable coating, with the abradable coating having, at its transition to at least one groove, a rim which is completely bordered by the material of the component forming the main flow path confinement, and with a recess which locally precludes rubbing of the blade end being provided at the blade end in at least one location at which the blade end is directly opposite to the material of the component bordering the abradable coating, with the signature lines of at least one groove, i.e. the frontal line LF, the groove aperture starting line LC and the groove aperture terminating line LD, extending exactly in the circumferential direction along the main flow path confinement, with at least one signature line of at least one groove (frontal line LF, groove aperture starting line LC, groove aperture terminating line LD) featuring a varying course along the circumference in the meridional direction with the circumferentially and meridionally varying course of the at least one signature line of at least one groove being periodical, with the cross-sectional shape of at least one groove, as viewed in the meridional section, varying along the circumference, with the course of at least one groove along the circumference being completely interrupted at least once, with neighboring ends of at least one groove being arranged meridionally offset in the area of the interruption, with the depth h of at least one groove, at least over a section of its course, increasing continuously in the direction of the relative movement of the respective blade end, with at least one deflector being provided within at least one groove which presents a local obstacle to a groove-internal flow and is provided such that a change in the flow direction is obtained, with the at least one deflector being set back from main flow path confinement such that a free edge of the deflector, over part of its course, is tangential to only the rectilinear connection of the groove aperture points C and D, if ever, with a groove-internal deflector being provided which, for better flow guidance, is provided with a curvature and/or profile in the area of its free edge.

LIST OF REFERENCE NUMERALS

1 Casing
2 Annulus duct/main flow path
3 Rotor drum (hub)
4 Machine axis
5 Blade/blade row
6 Hub or casing assembly
7 Annular groove/groove (oriented in the upstream direction)
9 Upstream blade row (optional)
10 Slot/groove
11 Gap/running gap
12 Groove aperture
13 Circumferential groove

What is claimed is:

1. A fluid-flow machine comprising:

a hub;

a casing;

a main flow path which is confined by the hub and the casing and in which at least one row of blades is arranged;

a gap being provided on at least one blade row between a blade end and a main flow path confinement, with the blade end and the main flow path confinement performing a rotary movement relative to each other;

at least one groove extending essentially in a circumferential direction of the machine positioned on the main flow path confinement in an area of the gap along at least part of a circumference of one of the hub and the casing, with an extension of the groove in the circumferential direction being large as compared to an extension of the groove in a meridional flow direction, a cross-sectional area of the groove, in meridional view of the fluid-flow machine, essentially departing from a parallelogrammic shape and, due to its contour, being inclined in an upstream direction, and wherein a centroid of the groove cross-sectional area is positioned upstream of a center of the groove aperture on the main flow path:

wherein the at least one groove has a strongly upstream inclined shape whose characteristics are defined by a grid of six auxiliary lines in a meridional plane set up by an axial direction x and a radial direction r, with a) all auxiliary lines extending parallel or vertical to a reference direction A-B along the blade end, where point A is a blade leading-edge corner point and point B is a blade trailing-edge corner point, b) a line L1 extending parallel to A-B through the groove aperture terminating point D, c) a line L2 extending parallel to L1 through the groove aperture starting point C, d) a line L3 extending parallel to L1 and tangentially along the groove contour, so that it has at least one point G in common with L3 at a position with maximum groove penetration depth h, e) a line L4 extending vertically to L1 and tangentially along the groove contour, so that it has at least one point F in common with L4 at a position with maximum upstream groove overhang m, f) a line L5 extending vertically to L1 and tangentially along the groove contour, so that in accordance with the present invention, it has at least one point E in common with L5 at a position with maximum downstream groove overhang n, g) a line L6 extending vertically to L1 through the groove aperture starting point C and dividing the cross-sectional area of the groove into a zone $A_F$ situated upstream of L6 and a zone $A_R$ situated downstream of L6, h) the centroid S of the groove total cross-sectional area and the groove aperture center M are separated by a distance d, i) a groove aperture width w being given between the rim points C and D of the groove aperture, j) an offset k being provided between the auxiliary lines L1 and L2, k) the blade having a meridional chord length Lm at its end, and with the characteristics of the groove being established as follows:

$$w/Lm<0.2 \text{ and } h/w<10 \text{ and } d/w>0.05 \text{ and } m/w>0.1 \text{ and}$$

$$AF/AR>0.1 \text{ and amount of } (k/w)<2.$$

2. The fluid-flow machine of claim 1, wherein the position of the at least one groove, described by a distance VN between a blade leading-edge corner point A and a groove aperture starting point C, is established by a condition $-0.25<VN/Lm<0.95$, with Lm being a meridional chord length at the blade end at the gap.

3. The fluid-flow machine of claim 2, wherein the position of the at least one groove relative to the blade leading edge is defined as follows: $-0.15<VN/Lm<0.35$.

4. The fluid-flow machine of claim 3, wherein the position of the at least one groove relative to the blade leading edge is defined as follows: $-0.15<VN/Lm<0.15$.

5. The fluid-flow machine of claim 1, wherein an inclination angle of a groove contour $\gamma_R$ exclusively assumes values between 0° and 90° in an area of the surface $A_R$ in a section between the groove aperture terminating point D and the point G with maximum groove penetration depth.

6. The fluid-flow machine of claim 5, wherein the groove contour is linear or concave (as referred to the groove interior) in the area of the surface $A_R$ in at least one part of the section between the groove aperture terminating point D and the point G with maximum groove penetration depth.

7. The fluid-flow machine of claim 6, wherein the inclination angle of the groove contour $\gamma_R$ assumes values between 15° and 55° at the groove aperture terminating point D.

8. The fluid-flow machine of claim 7, wherein an inclination angle of a groove contour $\gamma_r$ exclusively assumes values between 0° and 90° in an area of the surface $A_F$ in a section between the groove aperture starting point C and the point F with maximum upstream extension.

9. The fluid-flow machine of claim 8, wherein the groove contour is at least one of linear and concave (as referred to a groove interior) in the area of the surface $A_F$ in at least one part of the section between the groove aperture starting point C and the point F with maximum upstream extension.

10. The fluid-flow machine of claim 9, wherein the inclination angle of the groove contour $\gamma_F$ assumes values between 15° and 55° at the groove aperture starting point C.

11. The fluid-flow machine of claim 1, and further comprising a blade abradable coating provided together with the at least one groove as a main flow path confinement in the area of the running gap, with the abradable coating being provided only within a section of a meridional extension of the blade running path and the running gap, respectively, and with the abradable coating being confined in at least one of an upstream and downstream direction by a groove such that at least one of a blade leading-edge corner point A and a blade trailing-edge corner point lies in a section not covered by abradable coating.

12. The fluid-flow machine of claim 11, wherein the abradable coating, at its transition to at least one groove, has a rim, which is completely bordered by a material of the component forming the main flow path confinement, and that a recess which locally precludes rubbing of the blade end is provided at the blade end in at least one location at which the blade end is directly opposite to the material of the component bordering the abradable coating.

13. The fluid-flow machine of claim 1, wherein signature lines of at least one groove, including a frontal line LF, a groove aperture starting line LC and a groove aperture terminating line LD, extend exactly in the circumferential direction along the main flow path confinement.

14. The fluid-flow machine of claim 1, wherein at least one signature line of at least one groove, including at least one of a frontal line LF, a groove aperture starting line LC, and a groove aperture terminating line LD features a varying course along the circumference in the meridional direction.

15. The fluid-flow machine of claim 14, wherein the circumferentially and meridionally varying course of the at least one signature line of at least one groove is periodical.

16. The fluid-flow machine of claim 1, wherein the cross-sectional shape of the at least one groove, as viewed in the meridional section, varies along the circumference.

17. The fluid-flow machine of claim 1, wherein the course of the at least one groove along the circumference is completely interrupted at least once.

18. The fluid-flow machine of claim 17, wherein neighboring ends of the at least one groove are arranged meridionally offset in the area of the interruption.

19. The fluid-flow machine of claim 18, wherein a depth h of the at least one groove, at least over a section of its course, continuously increases in a direction of relative movement of the respective blade end.

20. The fluid-flow machine of claim 1, and further comprising at least one deflecting means positioned within the at least one groove which presents a local obstacle to a groove-internal flow and is provided such that a change in a flow direction is obtained, with the at least one deflector being set back from the main flow path confinement such that a free edge of the deflector, over part of its course, does not extend beyond tangential to a rectilinear connection of the groove aperture points C and D.

21. The fluid-flow machine of claim 20, wherein the deflector includes at least one of a curvature and a profile in the area of its free edge.

* * * * *